US008980508B2

(12) United States Patent
Okuda et al.

(10) Patent No.: US 8,980,508 B2
(45) Date of Patent: Mar. 17, 2015

(54) ELECTROPHOTOGRAPHIC PHOTOSENSITIVE MEMBER, PROCESS CARTRIDGE, ELECTROPHOTOGRAPHIC APPARATUS AND METHOD OF MANUFACTURING THE ELECTROPHOTOGRAPHIC PHOTOSENSITIVE MEMBER

(75) Inventors: Atsushi Okuda, Yokohama (JP); Harunobu Ogaki, Suntou-gun (JP); Kazunori Noguchi, Suntou-gun (JP); Shio Murai, Toride (JP); Kazuhisa Shida, Kawasaki (JP); Takashi Anezaki, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/009,723

(22) PCT Filed: Mar. 30, 2012

(86) PCT No.: PCT/JP2012/059426
§ 371 (c)(1),
(2), (4) Date: Oct. 3, 2013

(87) PCT Pub. No.: WO2012/141079
PCT Pub. Date: Oct. 18, 2012

(65) Prior Publication Data

US 2014/0023962 A1 Jan. 23, 2014

(30) Foreign Application Priority Data

Apr. 12, 2011 (JP) ..... 2011-088440
Mar. 21, 2012 (JP) ..... 2012-063761

(51) Int. Cl.
*G03G 5/047* (2006.01)
*G03G 5/05* (2006.01)
*G03G 5/147* (2006.01)

(52) U.S. Cl.
CPC ..... *G03G 5/047* (2013.01); *G03G 5/05* (2013.01); *G03G 5/147* (2013.01)
USPC ..... 430/58.05; 430/133; 399/159

(58) Field of Classification Search
CPC ..... G03G 5/047; G03G 5/147; G03G 5/05
USPC ..... 430/58.05, 133; 399/159
See application file for complete search history.

(56) References Cited

U.S. PATENT DOCUMENTS 5,418,099 A 5/1995 Mayama et al.
6,991,881 B2 1/2006 Ogaki et al.
(Continued)

FOREIGN PATENT DOCUMENTS

EP 0 570 908 A1 11/1993
EP 2 306 248 A1 4/2011
(Continued)

OTHER PUBLICATIONS

European Search Report dated Sep. 17, 2014 in European Application No. 12770978.0.
(Continued)

*Primary Examiner* — Peter Vajda
(74) *Attorney, Agent, or Firm* — Fitzpatrick, Cella, Harper and Scinto

(57) ABSTRACT

A charge-transporting layer, which is a surface layer of an electrophotographic photosensitive member, has a matrix-domain structure having a matrix containing constituent β (a polyester resin having a predetermined repeating structural unit) and a charge-transporting substance, and a domain containing constituent α (a polycarbonate resin having a repeating structural unit having a predetermined siloxane moiety).

5 Claims, 1 Drawing Sheet

(56) References Cited

U.S. PATENT DOCUMENTS

| | | | | |
|---|---|---|---|---|
| 6,994,941 | B2 | 2/2006 | Tanaka et al. | |
| 7,001,699 | B2 | 2/2006 | Tanaka et al. | |
| 7,045,261 | B2 | 5/2006 | Tanaka et al. | |
| 7,622,238 | B2 | 11/2009 | Uematsu et al. | |
| 7,875,410 | B2 | 1/2011 | Ogaki et al. | |
| 7,901,855 | B2 | 3/2011 | Ogaki et al. | |
| 7,927,774 | B2 | 4/2011 | Ogaki et al. | |
| 8,257,891 | B2 * | 9/2012 | Nakatake et al. | 430/59.6 |
| 2011/0177438 | A1 | 7/2011 | Noguchi et al. | |
| 2012/0263494 | A1 | 10/2012 | Okuda et al. | |
| 2012/0301181 | A1 | 11/2012 | Ogaki et al. | |
| 2012/0301182 | A1 * | 11/2012 | Anezaki et al. | 399/111 |
| 2013/0202326 | A1 | 8/2013 | Shida et al. | |
| 2013/0236823 | A1 | 9/2013 | Noguchi et al. | |
| 2014/0023961 | A1 | 1/2014 | Okuda et al. | |
| 2014/0093815 | A1 | 4/2014 | Yamamoto et al. | |

FOREIGN PATENT DOCUMENTS

| | | | |
|---|---|---|---|
| JP | 6-75415 | A | 3/1994 |
| JP | 2007-79555 | A | 3/2007 |
| JP | 2007-199688 | A | 8/2007 |
| JP | 4854824 | B1 | 1/2012 |
| WO | 2010/008095 | A1 | 1/2010 |

OTHER PUBLICATIONS

PCT International Search Report and Written Opinion of the International Searching Authority, International Application No. PCT/JP2012/059426, Mailing Date Jun. 12, 2012.

Nishi, et al., U.S. Appl. No. 14/152,438, filed Jan. 10, 2014.

Yamamoto, et al., U.S. Appl. No. 14/079,390, filed Nov. 13, 2013.

Yamamoto, et al., U.S. Appl. No. 14/078,502, filed Nov. 12, 2013.

* cited by examiner

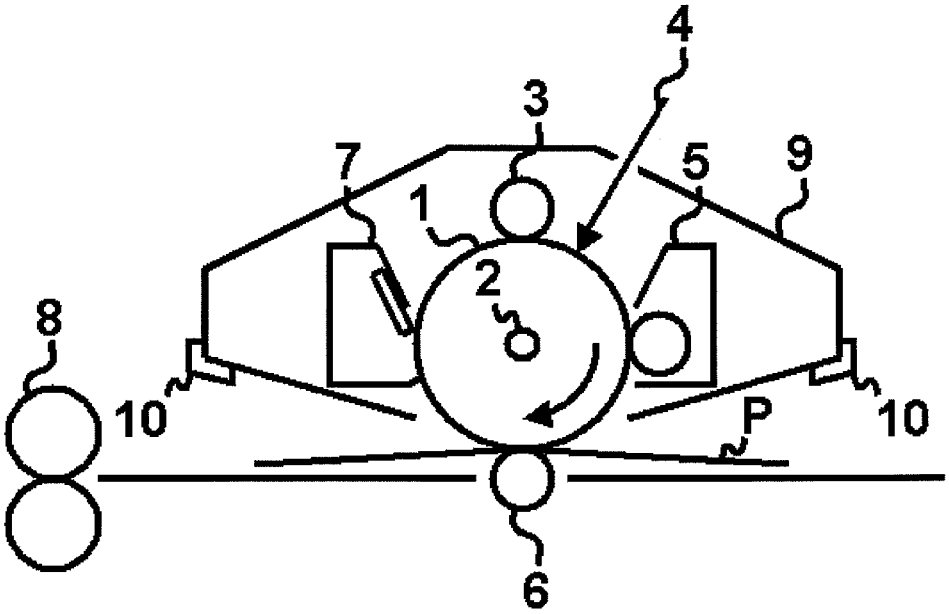
4
3
7
5
9
1
2
8
10
10
P
6

ELECTROPHOTOGRAPHIC PHOTOSENSITIVE MEMBER, PROCESS CARTRIDGE, ELECTROPHOTOGRAPHIC APPARATUS AND METHOD OF MANUFACTURING THE ELECTROPHOTOGRAPHIC PHOTOSENSITIVE MEMBER

TECHNICAL FIELD

The present invention relates to an electrophotographic photosensitive member, a process cartridge, an electrophotographic apparatus and a method of manufacturing the electrophotographic photosensitive member.

BACKGROUND ART

As an electrophotographic photosensitive member, which is to be loaded in an electrophotographic apparatus, an organic electrophotographic photosensitive member (hereinafter referred to as an "electrophotographic photosensitive member") containing an organic photoconductive substance (charge-generating substance) is known. In an electrophotographic process, various members such as a developer, a charging member, a cleaning blade, a paper sheet and a transfer member (hereinafter also referred to as "contact members") come into contact with the surface of the electrophotographic photosensitive member. Thus, in an electrophotographic photosensitive member, the occurrence of image degradation caused by contact stress with these contact members and the like is required to be reduced. Particularly, with recent improvement in the durability of an electrophotographic photosensitive member, the effect of reducing image degradation caused by contact stress in an electrophotographic photosensitive member has been required to persist.

In connection with persistent contact-stress reduction (mitigation), Patent Literature 1 proposes a method of forming a matrix-domain structure in a surface layer by using a siloxane resin having a siloxane structure integrated in a molecular chain. The method indicates that a polyester resin having a specific siloxane structure integrated therein is used to attain not only persistent contact-stress reduction but also potential stability (suppression of variation) during repeated use of an electrophotographic photosensitive member.

Meantime, there is a proposal in which a siloxane-modified resin having a siloxane structure in a molecular chain is added to the surface layer of an electrophotographic photosensitive member. Patent Literature 2 and Patent Literature 3 propose an electrophotographic photosensitive member containing a polycarbonate resin having a specific siloxane structure integrated therein. These literatures report effects such as improvements in solvent cracking resistance due to mold release characteristics and lubricity of the surface of a photosensitive member at an early stage of use.

CITATION LIST

Patent Literature

PTL 1: International Publication No. WO2010/008095

PTL 2: Japanese Patent Application Laid-Open No. H06-075415

PTL 3: Japanese Patent Application Laid-Open No. 2007-199688

SUMMARY OF INVENTION

Technical Problem

The electrophotographic photosensitive member disclosed in Patent Literature 1 has not only persistent contact-stress reduction but also potential stability during repeated use. However, as the result of the studies the present inventors further conducted, they found that further improvement is required. More specifically, based on the finding of Patent Literature 1, they used a polycarbonate resin having a specific siloxane structure integrated therein in an attempt to obtain the same effect; however, it was difficult to form an efficient matrix-domain structure in a surface layer when the polycarbonate resin is used. In addition, persistent contact-stress reduction and potential stability during repeated use of an electrophotographic photosensitive member both need to be improved.

Patent Literature 2 discloses an electrophotographic photosensitive member, which has the surface layer formed of a mixture of a polycarbonate resin having a specific siloxane structure integrated in the main chain thereof and a copolymerized polycarbonate resin having a specific structure without a siloxane structure. Cited Literature 2 also discloses that the electrophotographic photosensitive member is improved in crack resistance to a solvent and adhesion resistance to toner. However, the electrophotographic photosensitive member described in Patent Literature 2 is insufficient in persistent contact stress-reducing effect. Also, Patent Literature 3 discloses an electrophotographic photosensitive member, which has a surface layer formed of a mixture of a polycarbonate resin having a specific siloxane structure integrated in the main chain and at a terminal end and a polycarbonate resin having no siloxane structure. The Literature also discloses that lubricity during initial use is improved. However, the electrophotographic photosensitive member according to Patent Literature 3 is insufficient in persistent contact stress-reducing effect. The reason why the persistent contact stress-reducing effect is low is presumably because the resin according to Patent Literature 3 having a siloxane structure integrated therein has a high surface mobility.

An object of the present invention is to provide an electrophotographic photosensitive member excellent in ensuring not only persistent reduction of contact stress with contact members and the like but also potential stability during repeated use. Another object of the present invention is to provide a process cartridge and an electrophotographic apparatus having the electrophotographic photosensitive member. A further object of the present invention is to provide a method of manufacturing the electrophotographic photosensitive member.

Solution to Problem

The aforementioned objects can be attained by the following inventions.

The present invention relates to an electrophotographic photosensitive member, comprising:

a support, a charge-generating layer which is provided on the support and comprises a charge-generating substance, and a charge-transporting layer which is provided on the charge-generating layer and is a surface layer of the electrophotographic photosensitive member, wherein the charge-transporting layer has a matrix-domain structure having:

a domain which comprises the constituent $\alpha$; and a matrix which comprises the constituent β and a charge-transporting substance.

The constituent α is a polycarbonate resin A having a repeating structural unit represented by the following formula (A), a repeating structural unit represented by the following formula (B) and a repeating structural unit represented by the following formula (C). The content of a siloxane moiety in the polycarbonate resin A is not less than 5% by mass and not more than 40% by mass relative to the total mass of the polycarbonate resin A; the content of the repeating structural unit represented by the following formula (B) is not less than 10% by mass and not more than 30% by mass relative to the total mass of the polycarbonate resin A; and the content of the repeating structural unit represented by the formula (C) is not less than 25% by mass and less than 85% by mass relative to the total mass of the polycarbonate resin A.

(A)

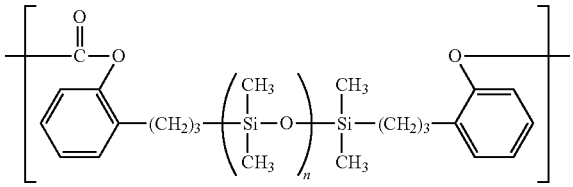

In the formula (A), "n" represents the number of repetitions of the structure within the bracket; and the average of "n" in the polycarbonate resin A ranges from 20 to 60.

(B)

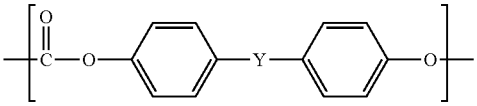

In the formula (B), Y represents an oxygen atom or a sulfur atom.

(C)

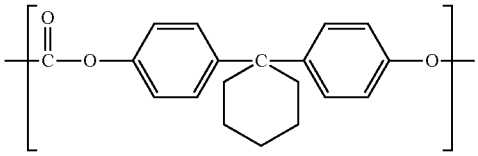

The constituent β is a polyester resin D having a repeating structural unit represented by the following formula (D).

(D)

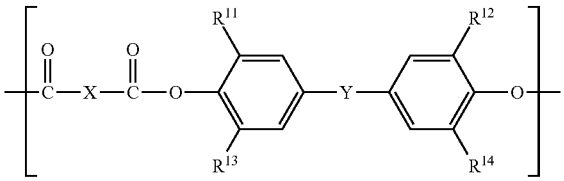

In the formula (D), $R^{11}$ to $R^{14}$ each independently represents a hydrogen atom or a methyl group; X represents a meta-phenylene group, a para-phenylene group or a bivalent group having two para-phenylene groups bonded with an oxygen atom; and Y represents a single bond, a methylene group, an ethylidene group or a propylidene group.

Furthermore, the present invention relates to a process cartridge detachably attached to a main body of an electrophotographic apparatus, wherein the process cartridge integrally supports:

the electrophotographic photosensitive member and at least one device selected from the group consisting of a charging device, a developing device, a transferring device and a cleaning device.

Furthermore, the present invention relates to an electrophotographic apparatus comprising: the electrophotographic photosensitive member, a charging device, an exposing device, a developing device and a transferring device.

Furthermore, the present invention relates to a method of manufacturing the electrophotographic photosensitive member, wherein the method comprises a step of forming the charge-transporting layer by applying a charge-transporting-layer coating solution on the charge-generating layer, and wherein the charge-transporting-layer coating solution comprises the constituents α and β and the charge-transporting substance.

Advantageous Effects of Invention

According to the present invention, an electrophotographic photosensitive member excellent in ensuring not only persistent reduction (mitigation) of contact-stress with contact members but also potential stability during repeated use can be provided.

Furthermore, according to the present invention, a process cartridge and an electrophotographic apparatus having the aforementioned electrophotographic photosensitive member can be provided. Moreover, according to the present invention, a method of manufacturing the electrophotographic photosensitive member can be provided.

Further features of the present invention will become apparent from the following description of exemplary embodiments with reference to the attached drawings.

BRIEF DESCRIPTION OF DRAWING

FIG. 1 is a view illustrating a schematic structure of an electrophotographic apparatus provided with a process cartridge having an electrophotographic photosensitive member of the present invention.

DESCRIPTION OF EMBODIMENTS

The electrophotographic photosensitive member of the present invention has a support, a charge-generating layer provided on the support and a charge-transporting layer provided on the charge-generating layer, and serving as a surface layer thereof, as described above. In the electrophotographic photosensitive member, the charge-transporting layer has a matrix-domain structure having a matrix containing a constituent (component) β and a charge-transporting substance and a domain containing a constituent (component) α.

The matrix-domain structure of the present invention is likened to a "sea-island structure". More specifically, the matrix corresponds to the sea, whereas the domain(s) corresponds to an island(s). The domain containing the constituent α represents a granular (island) structure formed in the matrix containing the constituent β and the charge-transporting substance. The domain(s) containing the constituent α are independently (discretely) present in the matrix. Such a matrix-domain structure can be confirmed by observation of a surface or a section of the charge-transporting layer.

The state of a matrix-domain structure can be observed or the size of a domain can be measured, for example, by a commercially available laser microscope, optical microscope, electron microscope or atomic force microscope. Using a microscope as mentioned above, the state of a matrix-domain structure can be observed or the size of a domain can be measured at a predetermined magnification.

In the present invention, the number average particle size of the domain containing the constituent α is desirably not less than 50 nm and not more than 1000 nm. Furthermore, the narrower the grain-size distribution of the domain, the more desirable in view of persistence of the contact stress-reducing effect. In the present invention, the number average particle size is computationally obtained as follows. Of the domains observed in a vertical cross-section of the charge-transporting layer of the present invention under microscopic observation, 100 domains are arbitrarily selected. The maximum diameters of the domains thus selected were measured and averaged to obtain the number average particle size of the domains. Note that image information in a depth direction can be obtained under microscopic observation of the section of the charge-transporting layer. In this way, a three dimensional image of the charge-transporting layer can be also obtained.

In the electrophotographic photosensitive member of the present invention, the matrix-domain structure of the charge-transporting layer can be formed by use of a charge-transporting layer coating liquid containing the constituents α and β and a charge-transporting substance. More specifically, the charge-transporting layer coating liquid is applied onto the charge-generating layer and dried to manufacture the electrophotographic photosensitive member of the present invention.

The matrix-domain structure of the present invention is a structure in which a domain containing the constituent α is formed in the matrix containing the constituent β and a charge-transporting substance. The domain containing the constituent α is formed not only in the surface of the charge-transporting layer but also in the interior portion of the charge-transporting layer. It is conceivable that because of the structure, a contact stress-reducing effect is persistently exhibited. To describe more specifically, a siloxane resin component having the contact stress-reducing effect, even if the component is reduced by rubbing and abrasion of a member such as a paper-sheet and a cleaning blade, can be presumably supplied from domains in the charge-transporting layer.

The present inventors consider the reason why the electrophotographic photosensitive member of the present invention is excellent in ensuring not only persistent contact-stress reduction and potential stability during repeated use, as follows.

In the electrophotographic photosensitive member having a charge-transporting layer having the matrix-domain structure of the present invention, in order to suppress potential variation during repeated use, it is important to reduce the content of a charge-transporting substance in the domain of the formed matrix-domain structure as much as possible.

Furthermore, it is conceivable that a domain is likely to be formed in the matrix by adding repeating structural unit represented by the formula (B) and repeating structural unit represented by the formula (C) in predetermined amounts to the structure of the polycarbonate resin A. This is because the polycarbonate resin A has a repeating structural unit represented by the formula (B) therein. To describe more specifically, a central skeleton of the formula (B), i.e., an ether structure or a thioether, is easily folded. Because of this, the polycarbonate resin A can be relatively freely arranged in a space. For these reasons, the polycarbonate resin A easily forms a domain. In the polycarbonate resin A, the content of the repeating structural unit represented by the formula (B) is not less than 10% by mass and not more than 30% by mass relative to the total mass of the polycarbonate resin A; whereas the content of the repeating structural unit represented by the formula (C) is not less than 25% by mass and less than 85% by mass relative to the total mass of the polycarbonate resin A. If the content of the repeating structural unit represented by the formula (B) is less than 10% by mass, the polycarbonate resin A is likely to spatially spread, facilitating separation of a charge-transporting layer coating liquid. Consequently, separation from a polyester resin D is extremely facilitated. As a result, the domain of the matrix-domain structure of the present invention fails to be formed. Light permeation through the charge-transporting layer decreases; a charge-transporting substance aggregates and precipitates on the surface of the charge-transporting layer. As a result, potential stability during repeated use decreases. If the content of the repeating structural unit represented by the formula (B) exceeds 30% by mass, formation of a domain becomes unstable and the sizes of the domains are likely to be nonuniform. As a result, potential stability during repeated use decreases. This is conceivably because the amount of charge-transporting substance taken in the domain increases.

Re: Constituent α

In the present invention, constituent α is a polycarbonate resin A having a repeating structural unit represented by the following formula (A), a repeating structural unit represented by the following formula (B) and a repeating structural unit represented by the following formula (C). In the polycarbonate resin A, the content of a siloxane moiety is not less than 5% by mass and not more than 40% by mass relative to the total mass of the polycarbonate resin A, the content of the repeating structural unit represented by the following formula (B) is not less than 10% by mass and not more than 30% by mass, and the content of the repeating structural unit represented by the following formula (C) is not less than 25% by mass and less than 85% by mass.

(A)

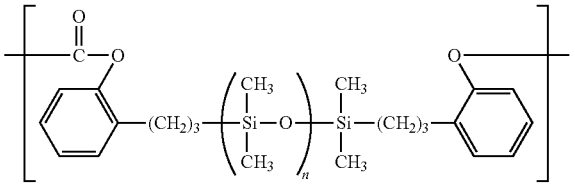

In the formula (A), "n" represents the number of repetitions of the structure enclosed in parentheses; and the average of "n" in the polycarbonate resin A ranges from 20 to 60.

(B)

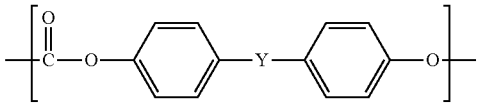

In the formula (B), Y represents an oxygen atom or a sulfur atom.

(C)

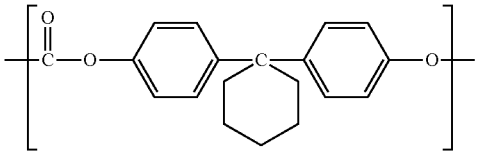

In the formula (A), n represents the number of repetitions of the structure enclosed in parentheses; and the average of n in the polycarbonate resin A ranges from 20 to 60, and further desirably from 30 to 50 in view of ensuring not only persistent stress reduction but also suppression of potential variation during repeated use. Furthermore, the number n of repetitions of the structure enclosed in parentheses is desirably in the range of the average value of the number n of repetitions ±10%, since the effect of the present invention can be stably obtained.

Table 1 shows examples of repeating structural unit represented by the formula (A) above.

TABLE 1

| Repeating structural unit represented by formula (A) | Average value of n |
|---|---|
| Repeating structural unit example (A-1) | 20 |
| Repeating structural unit example (A-2) | 30 |
| Repeating structural unit example (A-3) | 40 |
| Repeating structural unit example (A-4) | 50 |
| Repeating structural unit example (A-5) | 60 |

Of these, the repeating structural unit example (A-3) is desirable.

Furthermore, the polycarbonate resin A may have a siloxane structure represented by the following formula (E) as a terminal structure.

(E)

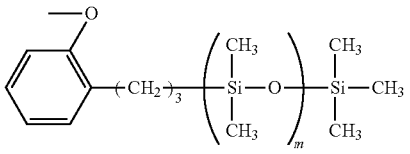

In the formula (E), m represents the number of repetitions of the structure enclosed in parentheses and the average value of m in the polycarbonate resin A is from 20 to 60 and further from 30 to 50; and it is more desirable that the average value of number n of repetitions of the structure enclosed in parentheses in the formula (A) is equal to the average value of the number m of repetitions of the structure enclosed in parentheses in the formula (E), in view of ensuring not only persistent stress reduction but also potential stability during repeated use. Further, the number m of repetitions of the structure enclosed in parentheses is desirably in the range of ±10% of the average value of number m of repetitions, since the effect of the present invention can be stably obtained.

Table 2 shows examples of the polycarbonate resin A having the repeating structural unit represented by the formula (A) as a siloxane structure and the repeating structural unit represented by the formula (E) as a terminal structure.

TABLE 2

| Repeating structural units represented by formulas (A) and (E) | Average value of n | Average value of m |
|---|---|---|
| Repeating structural unit example (A-6) | 20 | 20 |
| Repeating structural unit example (A-7) | 30 | 30 |
| Repeating structural unit example (A-8) | 40 | 40 |
| Repeating structural unit example (A-9) | 50 | 50 |
| Repeating structural unit example (A-10) | 60 | 60 |
| Repeating structural unit example (A-11) | 20 | 40 |
| Repeating structural unit example (A-12) | 40 | 20 |

Specific examples of the repeating structural unit represented by the formula (B) are shown below.

(B-1)

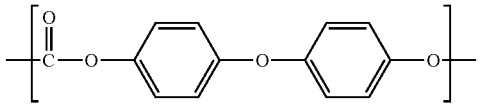

(B-2)

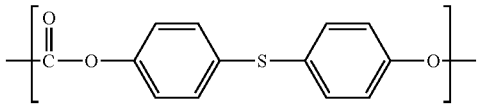

Of these, the repeating structural unit represented by the formula (B-1) is desirable.

Furthermore, the polycarbonate resin A contains the repeating structural unit represented by the formula (B) in an amount of not less than 10% by mass and not more than 30% by mass relative to the total mass of the polycarbonate resin A. If the content of the repeating structural unit represented by the formula (B) is not less than 10% by mass, the domain is efficiently formed in the matrix containing the constituent β and a charge-transporting substance. Furthermore, if the content of the repeating structural unit represented by the formula (B) is not more than 30% by mass, a charge-transporting substance is suppressed from aggregating in the domain containing the constituent α, with the result that potential stability during repeated use can be sufficiently obtained.

Next, the repeating structural unit represented by the formula (C) will be described. The polycarbonate resin A contains the repeating structural unit represented by the formula (C) in an amount of not less than 25% by mass and less than 85% by mass relative to the total mass of the polycarbonate resin A. If the content of the repeating structural unit represented by the formula (C) is not less than 25% by mass, a domain is efficiently formed in the matrix containing the constituent β and a charge-transporting substance. Furthermore, if the content of the repeating structural unit represented by the formula (C) is less than 85% by mass, a charge-transporting substance is suppressed from aggregating in the domain containing the constituent α, with the result that potential stability during repeated use can be sufficiently obtained.

Furthermore, the polycarbonate resin A contains a siloxane moiety in an amount of not less than 5% by mass and not more than 40% by mass relative to the total mass of the polycarbonate resin A. If the content of siloxane moiety is less than 5% by mass, a persistent contact stress-reducing effect cannot be sufficiently obtained and a domain cannot be efficiently formed in the matrix containing the constituent β and a charge-transporting substance. Furthermore, if the content of the siloxane moiety is more than 40% by mass, a charge-transporting substance forms aggregates in the domain containing the constituent α, with the result that potential stability during repeated use cannot be sufficiently obtained.

In the present invention, the siloxane moiety refers to a site containing silicon atoms positioned at both ends of the siloxane moiety, groups binding to the silicon atoms, an oxygen atom sandwiched by the silicon atoms, silicon atoms and groups binding to the silicon atoms. To describe more specifically, for example, in the case of the repeating structural unit represented by the following formula (A-S), the siloxane moiety of the present invention refers to the site surrounded by a broken line below. Furthermore, the polycarbonate resin A may have a siloxane structure as a terminal structure. In this case, similarly, the siloxane moiety refers to the site surrounded by a broken line below as shown in the case of repeating structural unit represented by the following formula (E-S). In this case, the content of the siloxane moiety in the polycarbonate resin A is a sum of the site surrounded by the broken line in the following formula (A-S) and the site surrounded by the broken line in the following formula (E-S) and the sum is not less than 5% by mass and not more than 40% by mass relative to the total mass of the polycarbonate resin A.

(A-S)

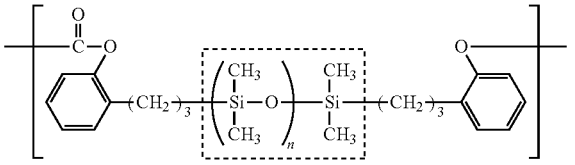

(E-S)

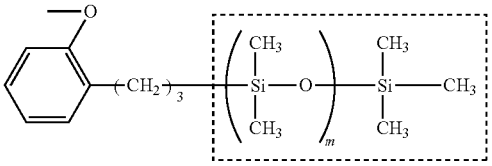

More specifically, the structures shown below are the siloxane moieties of the formula (A-S) and the formula (E-S) mentioned above.

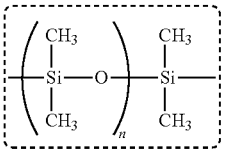

Siloxane moiety of the formula (A-S)

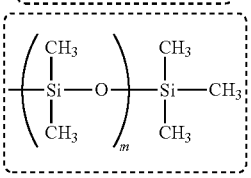

Siloxane moiety of the formula (E-S)

In the present invention, the content of a siloxane moiety relative to the total mass of the polycarbonate resin A can be obtained by a general analytic approach. Examples of the analytic approach are shown below.

First, the charge-transporting layer, which is a surface layer of an electrophotographic photosensitive member, is dissolved with a solvent. Thereafter, the solution is subjected to a fractionation apparatus capable of separating and recovering components, such as size exclusion chromatography and high performance liquid chromatography, to separate and recover various components contained in the surface layer, i.e., the charge-transporting layer. The polycarbonate resin A separated and recovered is hydrolyzed in the presence of alkali into a carboxylic acid moiety and a bisphenol and phenol site. The bisphenol and phenol moieties obtained are subjected to nuclear magnetic resonance spectrum analysis and mass spectrometry. In this manner, the number of repetitions of the siloxane moiety and the molar ratio thereof are computationally obtained and further converted into a content (mass ratio).

The polycarbonate resin A used in the present invention is a copolymer having a repeating structural unit represented by the formula (A), a repeating structural unit represented by the formula (B) and a repeating structural unit represented by the formula (C). The copolymer may take any configuration such as a block copolymer configuration, a random copolymer configuration and an alternate copolymer configuration.

The weight average molecular weight of the polycarbonate resin A used in the present invention is desirably not less than 30,000 and not more than 150,000 in view of forming a domain in the matrix containing the constituent β and a charge-transporting substance, and more desirably not less than 40,000 and not more than 100,000.

In the present invention, the weight average molecular weight of a resin is a polystyrene equivalent weight average molecular weight, which was measured in accordance with a customary method described in Japanese Patent Application Laid-Open No. 2007-79555.

In the present invention, the copolymerization ratio of the polycarbonate resin A can be checked in accordance with a conversion method using a peak position and peak area ratio of a hydrogen atom (constituting a resin) obtained by a general method, $^1$H-NMR measurement, of a resin.

The polycarbonate resin A used in the present invention can be synthesized, for example, by a phosgene method conventionally used or by a transesterification method.

The charge-transporting layer, which is a surface layer of the electrophotographic photosensitive member of the present invention, may contain a resin having a siloxane structure other than the polycarbonate resin A. Specific examples thereof include a polycarbonate resin having a siloxane structure, a polyester resin having a siloxane structure and an acryl resin having a siloxane structure. When another resin having a siloxane structure is used, the content of the constituent α in the charge-transporting layer is desirably not less than 90% by mass and less than 100% by mass relative to the total mass of the resins having a siloxane moiety in the charge-transporting layer in view of persistence of a contact stress-reducing effect and a potential stability effect during repeated use.

In the present invention, the content of a siloxane moiety of the polycarbonate resin A is desirably not less than 1% by mass and not more than 20% by mass relative to the total mass of all resins in the charge-transporting layer. If the content of a siloxane moiety is not less than 1% by mass and not more than 20% by mass, a matrix-domain structure is stably formed and not only persistent contact-stress reduction but also potential stability during repeated use can be ensured at high level. Furthermore, the content of a siloxane moiety of the polycarbonate resin A is more desirably not less than 2% by mass and not more than 10% by mass. This is because persistent contact-stress reduction and potential stability during repeated use can be further improved.

Re: Constituent β

The constituent β is a polyester resin D having the repeating structural unit represented by the following formula (D).

(D)

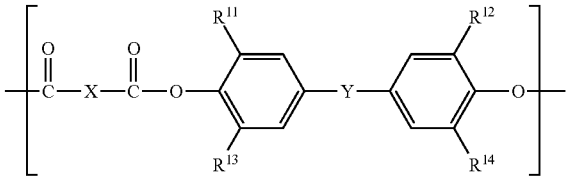

In the formula (D), $R^{11}$ to $R^{14}$ each independently represent a hydrogen atom or a methyl group; X represents a meta-phenylene group, a para-phenylene group or a bivalent group having two para-phenylene groups bonded with an oxygen atom; and Y represents a single bond, a methylene group, an ethylidene group or a propylidene group.

The polyester resin of the present invention contained in the constituent β and having the repeating structural unit represented by the formula (D) will be described. The polyester resin having the repeating structural unit represented by the formula (D) is rarely incorporated into a domain if the polycarbonate resin is used in combination with polycarbonate resin A and forms a uniform matrix with a charge-transporting substance. Because of this, the effects of persistent contact-stress reduction and potential stability during repeated use can be sufficiently obtained. The constituent β desirably has no siloxane moiety in view of forming a uniform matrix with a charge-transporting substance. Furthermore, the constituent β may contain another repeating structural unit besides the repeating structural unit represented by the formula (D) as a structure to be copolymerized with the formula (D). The content of the repeating structural unit represented by the formula (D) in the constituent β is desirably not less than 50% by mass, in view of forming a uniform matrix with a charge-transporting substance. Furthermore, the content of the repeating structural unit represented by the formula (D) is desirably not less than 70% by mass. Specific examples of the repeating structural units represented by the formula (D) will be described below.

(D-1)

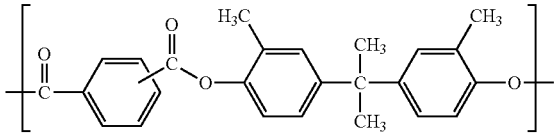

(D-2)

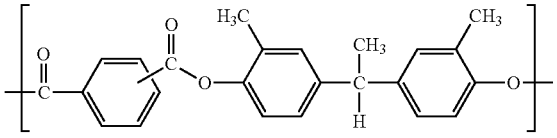

(D-3)

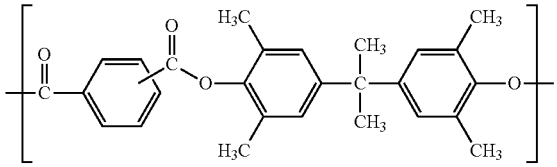

(D-4)

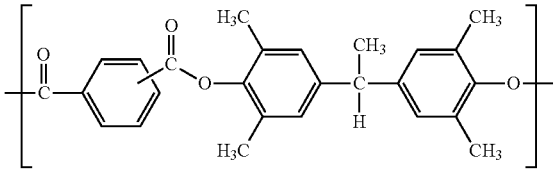

(D-5)

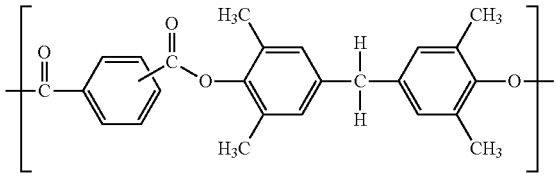

(D-6)

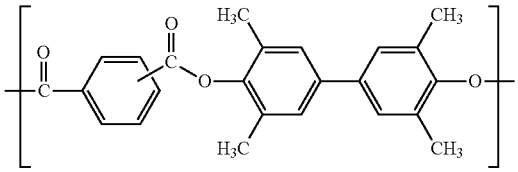

(D-7)

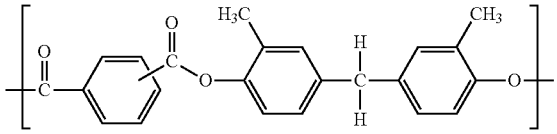

(D-8)

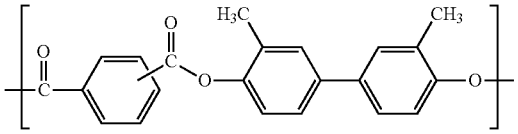

(D-9)

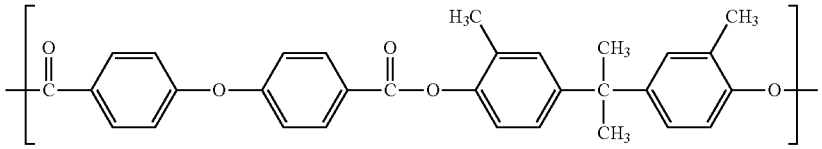

-continued (D-10)

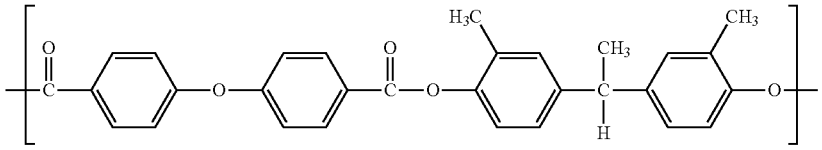

(D-11)

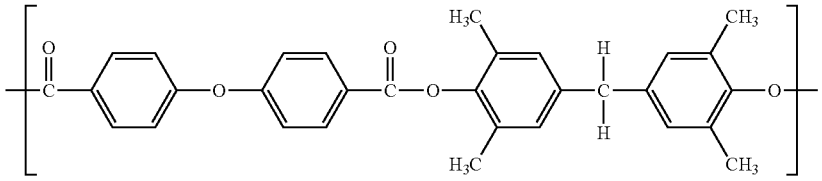

Of these, the repeating structural unit represented by the formula (D-1), (D-2), (D-5), (D-6), (D-9) or (D-10) is desirable.

Re: Charge-Transporting Substance

As a charge-transporting substance, a triarylamine compound, a hydrazone compound, a styryl compound and a stylbenzene compound are mentioned. These charge-transporting substances may be used alone or as a mixture of two or more. In the present invention, a compound having a structure represented by the following formula (1a), (1a'), (1b) or (1b') is used.

(1a)

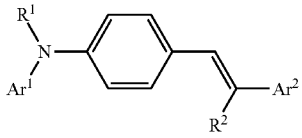

-continued (1a')

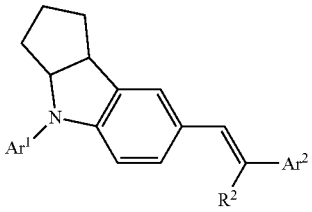

In the formula (1a) and the formula (1a'), $Ar^1$ represents a phenyl group or a phenyl group having a methyl group or an ethyl group as a substituent; $Ar^2$ represents a phenyl group or a phenyl group having a methyl group as a substituent, a phenyl group having a monovalent group represented by —CH═CH—Ta (where Ta represents a monovalent group derived from a benzene ring of triphenylamine by removing a single hydrogen atom or a monovalent group derived from a benzene ring of triphenylamine having a methyl group or an ethyl group as a substituent by removing a single hydrogen atom) as a substituent or a biphenylyl group; $R^1$ represents a phenyl group, a phenyl group having a methyl group as a substituent or a phenyl group having a monovalent group represented by —CH═C($Ar^3$)$Ar^4$ (where $Ar^3$ and $Ar^4$ each independently represent a phenyl group or a phenyl group having a methyl group as a substituent); and $R^2$ represents a hydrogen atom, a phenyl group or a phenyl group having a methyl group as a substituent.

(1b)

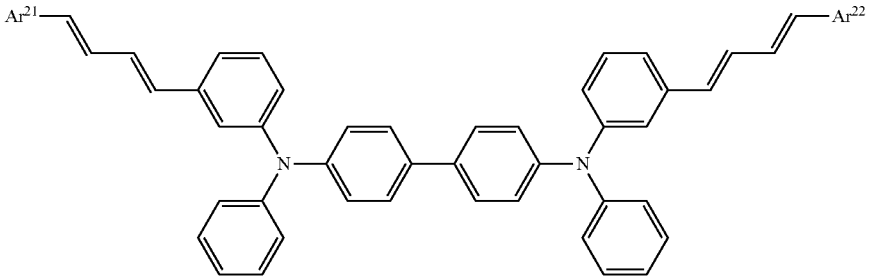

(1b')

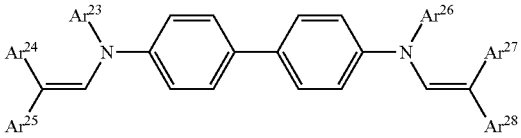

In the formula (1b), $Ar^{21}$ and $Ar^{22}$ each independently represent a phenyl group or a tolyl group. In the formula (1b'), $Ar^{23}$ and $Ar^{26}$ each independently represent a phenyl group or a phenyl group having a methyl group as a substituent; and $Ar^{24}$, $Ar^{25}$, $Ar^{27}$ and $Ar^{28}$ each independently represent a phenyl group or a tolyl group.

Specific examples of the charge-transporting substance used in the present invention will be described below. Note that the following formulas (1-1) to (1-10) are specific examples of the compound having the structure represented by the formula (1a) or (1a'). The following formulas (1-15) to (1-18) are specific examples of a compound having the structure represented by the formula (1b) or (1b').

(1-1)

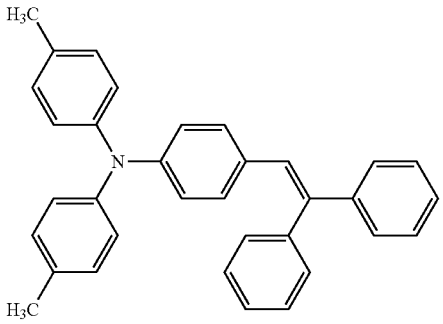

(1-2)

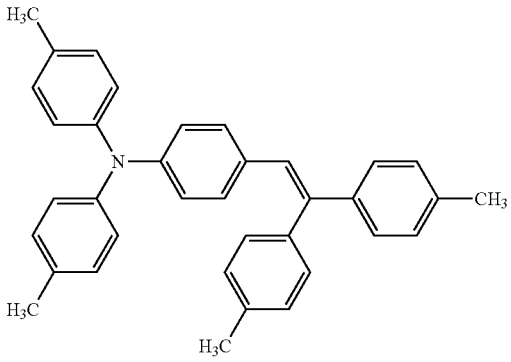

(1-3)

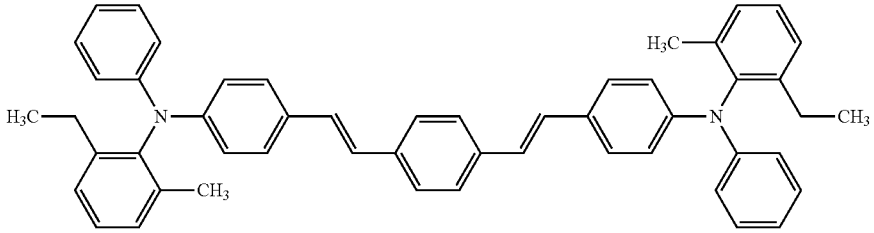

(1-4)

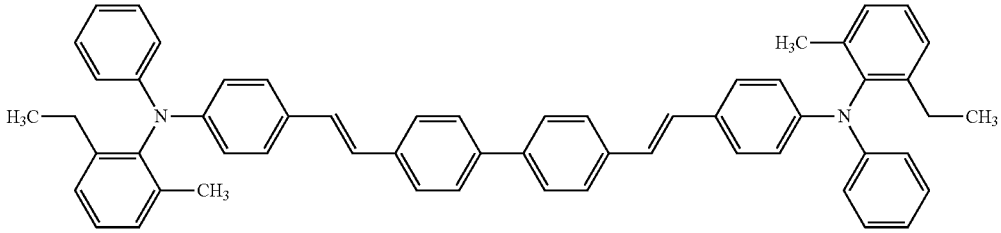

(1-5)

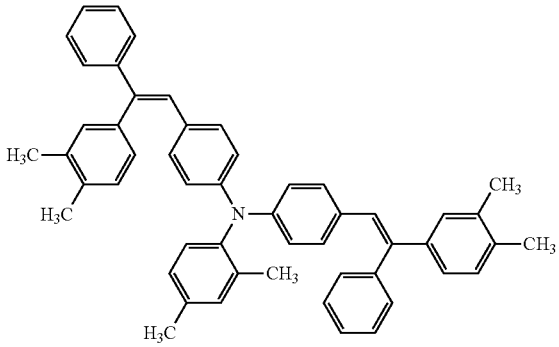

(1-6)

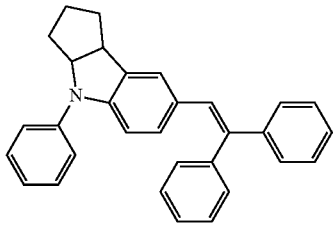

-continued
(1-7)
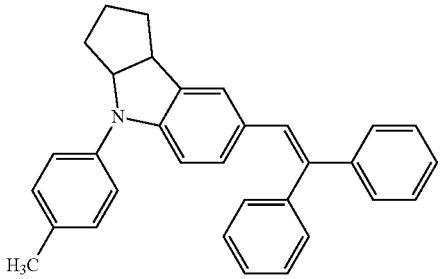
(1-8)
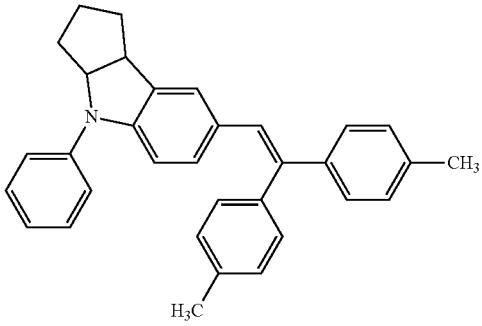
(1-9)
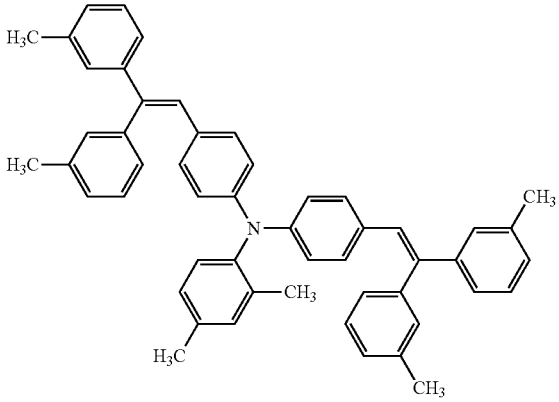
(1-10)
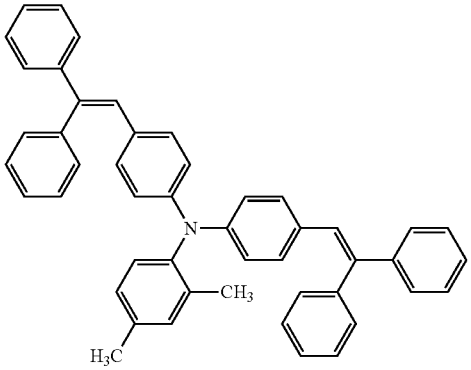
(1-11)
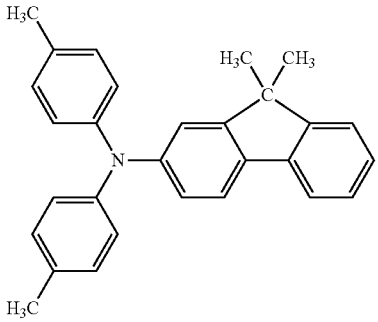
(1-12)
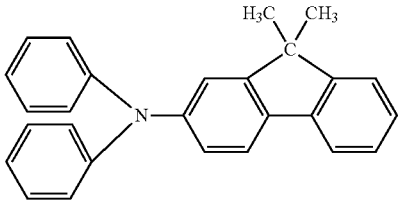
(1-13)
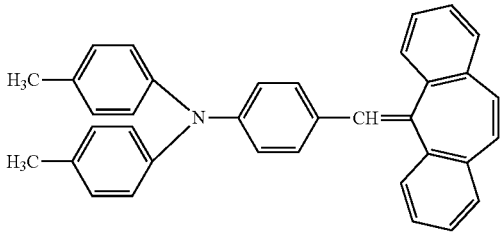
(1-14)
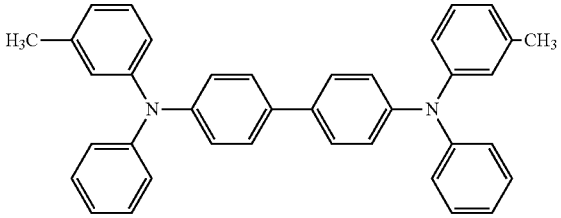

-continued (1-15)

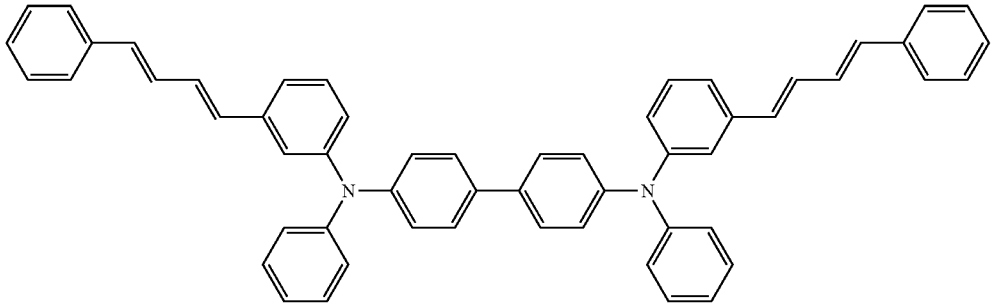

(1-16)

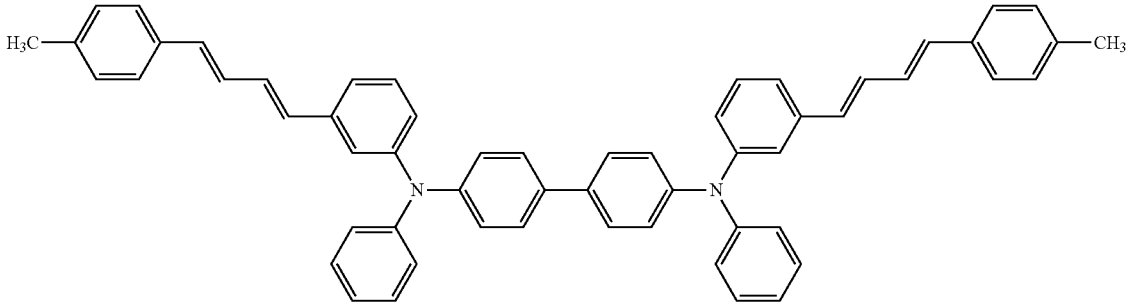

(1-17)

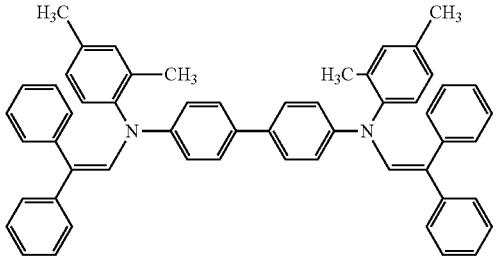

(1-18)

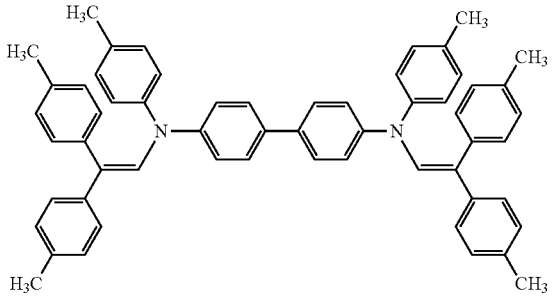

Of these, the charge-transporting substance is desirably a compound having a structure represented by the formula (1-1), (1-3), (1-5), (1-7), (1-11), (1-13), (1-14), (1-15) or (1-17) above.

The charge-transporting layer, which is the surface layer of the electrophotographic photosensitive member of the present invention, contains a polycarbonate resin A and a polyester resin D as a resin; however, another resin may be blended. Examples of the resin that may be additionally blended include an acryl resin, a polyester resin and a polycarbonate resin. Of these, in view of improving electrophotographic properties, a polycarbonate resin is desirable. When another resin is blended, the ratio of the polyester resin D to the resin to be blended, that is, the content of the polyester resin D, is desirably in the range of not less than 90% by mass and less than 100% by mass. In the present invention, when another resin is blended in place of the polyester resin D, in view of forming uniform matrix with a charge-transporting substance, the another resin to be blended desirably contains no siloxane structure.

Specific examples of the polycarbonate resin that may be blended desirably include resins having repeating structural units represented by the following formulas (2-1) and (2-2).

(2-1)

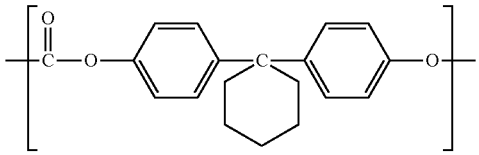

(2-2)

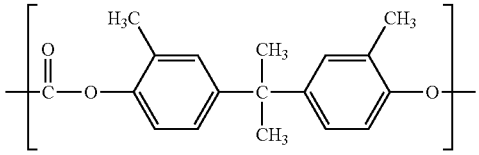

Next, a synthesis example of the polycarbonate resin A, which is the constituent α used in the present invention will be described. The polycarbonate resin A can be synthesized by use of the synthesis method described in Patent Literature 3. Also in the present invention, the same synthesis method was employed to synthesize polycarbonate resins A shown in synthesis examples of Table 3 using raw materials corresponding to the repeating structural unit represented by the formula (A), the structure unit represented by the formula (B) and the structure unit represented by the formula (C). The weight average molecular weights of the polycarbonate resins A synthesized and the contents of siloxane moieties of polycarbonate resins A are shown in Table 3.

Note that in Table 3, polycarbonate resins A (1) to A (31) each are a polycarbonate resin A having the repeating structural unit represented by the formula (A) alone as a siloxane moiety. Polycarbonate resins A (32) to A (40) each are a polycarbonate resin A having not only the repeating structural unit represented by the formula (A) but also the repeating structural unit represented by the formula (E) as a siloxane moiety. The content of a siloxane moiety in Table 3, as described above, is the sum of siloxane moieties contained in the repeating structural unit represented by the formula (A) and repeating the structural unit represented by the formula (E) in the polycarbonate resin A. Polycarbonate resins A (32) to A (40) were synthesized so that the ratio of a raw material for the repeating structural unit represented by the formula (A) to a raw material for repeating structural unit represented by the formula (E) was 1:1 (by mass).

(33), the maximum value of number n of repetitions of the structure enclosed in parentheses represented by the formula (A) above was 43 and the minimum value thereof was 37, and the maximum value of number m of repetitions of the structure enclosed in parentheses represented by the formula (E) above was 42 and the minimum value thereof was 38.

Next, the structure of the electrophotographic photosensitive member of the present invention will be described.

The electrophotographic photosensitive member of the present invention has a support, a charge-generating layer provided on the support and a charge-transporting layer provided on the charge-generating layer. Furthermore, the charge-transporting layer is provided as the surface layer (the uppermost layer) of the electrophotographic photosensitive member.

Furthermore, the charge-transporting layer of the electrophotographic photosensitive member of the present invention contains the constituent α, the constituent β mentioned above and a charge-transporting substance. Furthermore, the charge-transporting layer may have a layered structure. In this case, at least in the surface-side charge-transporting layer, a matrix-domain structure is formed.

TABLE 3

| Component [α] (Polycarbonate resin A) | Repeating structural unit represented by formula (A) | Repeating structural unit represented by the formula (B) | Repeating structural unit represented by the formula (C) | Content of siloxane moiety in polycarbonate resin A (% by mass) | Content of the formula (B) in polycarbonate resin (% by mass) | Content of the formula (C) in polycarbonate resin (% by mass) | Weight average molecular weight (Mw) |
|---|---|---|---|---|---|---|---|
| Polycarbonate resin A (1) | (A-3) | (B-1) | (C) | 40 | 16 | 40 | 80000 |
| Polycarbonate resin A (2) | (A-3) | (B-1) | (C) | 30 | 16 | 51 | 60000 |
| Polycarbonate resin A (3) | (A-3) | (B-1) | (C) | 18 | 16 | 64 | 75000 |
| Polycarbonate resin A (4) | (A-3) | (B-1) | (C) | 10 | 16 | 73 | 50000 |
| Polycarbonate resin A (5) | (A-3) | (B-1) | (C) | 5 | 16 | 79 | 70000 |
| Polycarbonate resin A (6) | (A-3) | (B-1) | (C) | 5 | 10 | 84 | 73000 |
| Polycarbonate resin A (7) | (A-3) | (B-1) | (C) | 40 | 30 | 26 | 65000 |
| Polycarbonate resin A (8) | (A-3) | (B-1) | (C) | 5 | 30 | 65 | 80000 |
| Polycarbonate resin A (9) | (A-3) | (B-1) | (C) | 40 | 10 | 46 | 85000 |
| Polycarbonate resin A (10) | (A-1) | (B-1) | (C) | 40 | 10 | 42 | 70000 |
| Polycarbonate resin A (11) | (A-1) | (B-1) | (C) | 30 | 30 | 34 | 66000 |
| Polycarbonate resin A (12) | (A-1) | (B-1) | (C) | 5 | 10 | 84 | 90000 |
| Polycarbonate resin A (13) | (A-1) | (B-1) | (C) | 40 | 27 | 25 | 77000 |
| Polycarbonate resin A (14) | (A-2) | (B-1) | (C) | 40 | 29 | 26 | 70000 |
| Polycarbonate resin A (15) | (A-2) | (B-1) | (C) | 20 | 20 | 57 | 68000 |
| Polycarbonate resin A (16) | (A-2) | (B-1) | (C) | 5 | 10 | 84 | 85000 |
| Polycarbonate resin A (17) | (A-2) | (B-1) | (C) | 40 | 10 | 45 | 65000 |
| Polycarbonate resin A (18) | (A-4) | (B-1) | (C) | 40 | 30 | 27 | 75000 |
| Polycarbonate resin A (19) | (A-4) | (B-1) | (C) | 20 | 20 | 58 | 90000 |
| Polycarbonate resin A (20) | (A-4) | (B-1) | (C) | 5 | 10 | 84 | 54000 |
| Polycarbonate resin A (21) | (A-4) | (B-1) | (C) | 40 | 10 | 47 | 60000 |
| Polycarbonate resin A (22) | (A-5) | (B-1) | (C) | 40 | 30 | 27 | 70000 |
| Polycarbonate resin A (23) | (A-5) | (B-1) | (C) | 20 | 20 | 59 | 72000 |
| Polycarbonate resin A (24) | (A-5) | (B-1) | (C) | 5 | 10 | 84 | 70000 |
| Polycarbonate resin A (25) | (A-5) | (B-2) | (C) | 40 | 10 | 47 | 55000 |
| Polycarbonate resin A (26) | (A-3) | (B-2) | (C) | 40 | 30 | 26 | 80000 |
| Polycarbonate resin A (27) | (A-3) | (B-2) | (C) | 20 | 20 | 58 | 60000 |
| Polycarbonate resin A (28) | (A-3) | (B-2) | (C) | 5 | 10 | 84 | 65000 |
| Polycarbonate resin A (29) | (A-3) | (B-2) | (C) | 40 | 10 | 46 | 75000 |
| Polycarbonate resin A (30) | (A-2) | (B-2) | (C) | 20 | 20 | 57 | 73000 |
| Polycarbonate resin A (31) | (A-4) | (B-2) | (C) | 20 | 20 | 58 | 85000 |
| Polycarbonate resin A (32) | (A-8) | (B-1) | (C) | 40 | 30 | 27 | 80000 |
| Polycarbonate resin A (33) | (A-8) | (B-1) | (C) | 19 | 16 | 65 | 75000 |
| Polycarbonate resin A (34) | (A-8) | (B-1) | (C) | 5 | 10 | 84 | 77000 |
| Polycarbonate resin A (35) | (A-8) | (B-1) | (C) | 40 | 10 | 47 | 64000 |
| Polycarbonate resin A (36) | (A-7) | (B-1) | (C) | 20 | 20 | 58 | 71000 |
| Polycarbonate resin A (37) | (A-7) | (B-2) | (C) | 20 | 20 | 58 | 73000 |
| Polycarbonate resin A (38) | (A-8) | (B-1) | (C) | 20 | 20 | 59 | 64000 |
| Polycarbonate resin A (39) | (A-11) | (B-1) | (C) | 20 | 20 | 58 | 92000 |
| Polycarbonate resin A (40) | (A-12) | (B-1) | (C) | 20 | 20 | 58 | 83000 |

In a polycarbonate resin A (3), the maximum value of number n of repetitions of the structure enclosed in parentheses represented by the formula (A-3) above was 43 and the minimum value thereof was 37. In polycarbonate resin A As the electrophotographic photosensitive member, generally, a cylindrical electrophotographic photosensitive member, in which a photosensitive layer (charge-generating layer, charge-transporting layer) is formed on a cylindrical support, is widely used; however, the electrophotographic photosensitive member may have a shape such as a belt and a sheet can be employed.

Support

As the support to be used in the electrophotographic photosensitive member of the present invention, a support having conductivity (conductive support) is desirably used. Examples of the material for the support include aluminium, aluminum alloy and stainless steel. In the case of a support made of aluminum or aluminum alloy, an ED tube, an EI tube and a support prepared by treating these with machining, electrochemical mechanical polishing, wet-process or dry-process honing can be used. Furthermore, examples thereof include a metal support and a resin support having a thin film of a conductive material such as aluminum, aluminum alloy or an indium oxide-tin oxide alloy formed thereon. The surface of the support may be subjected to a machining treatment, a roughening treatment, an alumite treatment, etc.

Furthermore, a resin containing e.g., a conductive particle such as carbon black, a tin oxide particle, a titanium oxide particle and a silver particle therein and a plastic having a conductive resin can be used as the substrate.

In the electrophotographic photosensitive member of the present invention, a conductive layer having a conductive particle and a resin may be provided on a support. The conductive layer is formed by using a conductive-layer coating liquid having a conductive particle dispersed in a resin. Examples of the conductive particle include carbon black, acetylene black, a powder of a metal such as aluminium, nickel, iron, nichrome, copper, zinc and silver and a powder of a metal oxide such as conductive tin oxide and ITO. Examples of the resin to be used in the conductive layer include a polyester resin, a polycarbonate resin, a polyvinyl butyral resin, an acrylic resin, a silicone resin, an epoxy resin, a melamine resin, a urethane resin, a phenol resin and an alkyd resin.

Examples of a solvent for the conductive-layer coating liquid include an ether solvent, an alcohol solvent, a ketone solvent and an aromatic hydrocarbon solvent. The film thickness of the conductive layer is desirably not less than 0.2 μm and not more than 40 μm, more desirably not less than 1 μm and not more than 35 μm, and further more desirably not less than 5 μm and not more than 30 μm.

In the electrophotographic photosensitive member of the present invention, an intermediate layer may be provided between the support or the conductive layer and the charge-generating layer.

The intermediate layer can be formed by applying an intermediate-layer coating liquid containing a resin onto a support or a conductive layer followed by drying or hardening.

Example of a resin for use in the intermediate layer include a polyacrylic acid, methyl cellulose, ethyl cellulose, a polyamide resin, a polyimide resin, a polyamide imide resin, a polyamidic acid resin, a melamine resin, an epoxy resin and a polyurethane resin. As the resin to be used in the intermediate layer, a thermoplastic resin is desirable. More specifically, a thermoplastic polyamide resin is desirable. As the polyamide resin, a low crystalline or amorphous copolymerized nylon is desirable since such a nylon can be applied in the form of solution.

The film thickness of the intermediate layer is desirably not less than 0.05 μm and not more than 40 μm and more desirably not less than 0.1 μm and not more than 30 μm. Furthermore, the intermediate layer may contain a semi-conductive particle, an electron transporting substance or an electron receiving substance.

Charge-Generating Layer

In the electrophotographic photosensitive member of the present invention, a charge-generating layer is provided on a support, a conductive layer or an intermediate layer.

Examples of the charge-generating substance to be used in the electrophotographic photosensitive member of the present invention include an azo pigment, a phthalocyanine pigment, an indigo pigment and a perylene pigment. These charge-generating substances may be used singly or as a mixture of two or more types. Of these, in particular, oxytitanium phthalocyanine, hydroxygallium phthalocyanine and chlorogallium phthalocyanine are desirable because of high sensitivity.

Examples of the resin to be used in the charge-generating layer include a polycarbonate resin, a polyester resin, a butyral resin, a polyvinyl acetal resin, an acrylic resin, a vinyl acetate resin and a urea resin. Of these, a butyral resin is particularly desirable. These resins may be used singly, as a mixture or a copolymer of two or more.

The charge-generating layer is formed by applying a charge-generating layer coating liquid, which is obtained by dispersing a charge-generating substance together with a resin and a solvent, followed by drying. Furthermore, the charge-generating layer may be a charge-generating substance deposition film.

As a dispersion method, a method using a homogenizer, a supersonic wave, a ball mill, a sand mill, an attritor or a roll mill is mentioned.

The ratio of a charge-generating substance and a resin is as follows. The content of a charge-generating substance is desirably not less than 0.1 parts by mass and not more than 10 parts by mass relative to 1 part by mass of the resin, and more desirably not less than 1 part by mass and not more than 3 parts by mass.

As the solvent to be used for the charge-generating layer coating liquid, an alcohol solvent, a sulfoxide solvent, a ketone solvent, an ether solvent, an ester solvent or an aromatic hydrocarbon solvent is mentioned.

The film thickness of the charge-generating layer is desirably not less than 0.01 μm and not more than 5 μm and more desirably not less than 0.1 μm and not more than 2 μm. Furthermore, to the charge-generating layer, if necessary, various types of sensitizers, antioxidants, UV ray absorbing agent and plasticizers can be added. Furthermore, to keep smooth charge-flow through the charge-generating layer, an electron-transferring substance or an electron receiving substance may be added to the charge-generating layer.

Charge-Transporting Layer

In the electrophotographic photosensitive member of the present invention, a charge-transporting layer is provided on a charge-generating layer.

The charge-transporting layer, which is the surface layer of the electrophotographic photosensitive member of the present invention, contains the constituent α, the constituent β and a charge-transporting substance. As mentioned above, another resin may further be blended. Examples of the resin to be blended are as mentioned above. The charge-transporting substances to be used in the charge-transporting layer of the present invention may also be used singly or as a mixture of two or more types.

The charge-transporting layer can be formed by applying a charge-transporting layer coating liquid, which is obtained by dissolving a charge-transporting substance and resins as mentioned above in a solvent, followed by drying the applied liquid.

The ratio of a charge-transporting substance and a resin is as follows. The content of a charge-transporting substance is desirably not less than 0.4 parts by mass and not more than 2 parts by mass relative to 1 part by mass of the resin, and more desirably not less than 0.5 parts by mass and not more than 1.2 parts by mass.

As the solvent to be used for the charge-transporting layer coating liquid, a ketone solvent, an ester solvent, an ether solvent and an aromatic hydrocarbon solvent are mentioned. These solvents may be used singly or as a mixture of two or more types. Of these solvents, an ether solvent, or an aromatic hydrocarbon solvent is desirably used in view of resin solubility.

The film thickness of the charge-transporting layer is desirably not less than 5 μm and not more than 50 μm and more desirably, not less than 10 μm and not more than 35 μm. Furthermore, to the charge-transporting layer, if necessary, an antioxidant, a UV ray absorbing agent, a plasticizer, etc., can be added.

To each of the layers of the electrophotographic photosensitive member of the present invention, various types of additives can be added. Examples of the additives include antidegradants such as an antioxidant, an ultraviolet absorber and a light stabilizer; and microparticles such as an organic microparticle and an inorganic microparticle. Examples of the antidegradants include hindered phenolic antioxidant, hindered amine light stabilizer, a sulfur atom-containing antioxidant and a phosphorus atom-containing antioxidant. Examples of the organic microparticle include polymer resin particles such as a fluorine-atom containing resin particle, a polystyrene microparticle and a polyethylene resin particle. Examples of the inorganic microparticle include particles of an oxide of a metal such as silica and alumina.

When a coating liquid for each layer is applied, a coating method such as a dip coating method, a spray coating method, a spinner coating method, a roller coating method, Mayer bar coating method, a blade coating method can be used.

Electrophotographic Apparatus

FIG. 1 illustrates an example of a schematic structure of an electrophotographic apparatus provided with a process cartridge having an electrophotographic photosensitive member of the present invention.

In FIG. 1, reference numeral 1 represents a cylindrical electrophotographic photosensitive member and rotationally driven about a shaft 2 in the direction of an arrow at a predetermined circumferential speed. The surface of the electrophotographic photosensitive member 1 rotationally driven is negatively and uniformly charged to a predetermined potential with a charging device (primary charging device: charge roller, etc.) 3 during a rotation process. Subsequently, the photosensitive member is exposed to light (image exposure light) 4, which is emitted from an exposing device (not shown) such as a slit exposure device and a laser beam scanning exposure device and the intensity of which is modulated so as to correspond to the electric digital-image signals of target image information serially sent with time. In this manner, an electrostatic latent image corresponding to a target image is sequentially formed on the surface of the electrophotographic photosensitive member 1.

The electrostatic latent image formed on the surface of the electrophotographic photosensitive member 1 is converted into a toner image by reverse development with toner contained in the developer of a developing device 5. Then, the toner images carried on the surface of the electrophotographic photosensitive member 1 are sequentially transferred to a transfer material (paper-sheet, etc.) P by a transfer bias from a transferring device (transfer roller) 6. Note that the transfer material P is taken out from a transfer material supply device (not shown) in synchronisms with the rotation of the electrophotographic photosensitive member 1 and fed to the space between the electrophotographic photosensitive member 1 and the transferring device 6 (contact section). Furthermore, to the transferring device 6, a bias voltage of a reverse polarity to that of the charge the toner has is applied by a bias power source (not shown).

The transfer material P having a toner image transferred thereto is separated from the surface of the electrophotographic photosensitive member 1 and loaded into a fixing device 8 in which the toner image is fixed and output from the apparatus as an image formed product (print, copy).

After a toner image is transferred, the developer remaining (remaining toner) without being transferred is removed by a cleaning device (cleaning blade, etc.) 7 to clear the surface of the electrophotographic photosensitive member 1. Subsequently, the surface of the electrophotographic photosensitive member 1 is discharged by pre-exposure light (not shown) from a pre-exposing device (not shown) and thereafter used for image formation repeatedly. Note that in the case where the charging device 3 is a contact charging device using a charge roller as shown in FIG. 1, pre-light exposure treatment is not always necessary.

In the present invention, a plurality of the constituents are selected from the aforementioned ones including the electrophotographic photosensitive member 1, charging device 3, developing device 5, transferring device 6, and cleaning device 7 and housed in a container. In this manner, they are integrated and constituted as a process cartridge. The process cartridge may be detachably attached to a main body of an electrophotographic apparatus such as a copying machine and a laser beam printer. In FIG. 1, an electrophotographic photosensitive member 1, a charging device 3, a developing device 5 and a cleaning device 7 are integrated in a cartridge and used as a process cartridge 9, which can detachably attached to a main body of an electrophotographic apparatus by use of guiding device 10 such as a rail.

The present invention will be more specifically described below by way of Examples and Comparative Examples. However, the present invention is not limited by the following Examples. Note that "parts" described in Examples means "parts by mass".

Example 1

An aluminum cylinder having a diameter of 30 mm and a length of 260.5 mm was used as a support. Next, a conductive-layer coating liquid was prepared by using a solvent mixture of $SnO_2$-coated barium sulfate (conductive particle) (10 parts), titanium oxide (resistance-controlling pigment) (2 parts), a phenol resin (6 parts) and silicone oil (leveling agent) (0.001 part) with a solvent mixture of methanol (4 parts) and methoxypropanol (16 parts). The aluminum cylinder was dip-coated with the conductive-layer coating liquid, hardened at 140° C. for 30 minutes (thermal hardening) to form a conductive layer having a film thickness of 15 μm.

Next, N-methoxymethylated nylon (3 parts) and copolymerized nylon (3 parts) were dissolved in a solvent mixture of methanol (65 parts) and n-butanol (30 parts) to prepare an intermediate-layer coating liquid. The conductive layer was dip-coated with the intermediate-layer coating liquid, and dried at 100° C. for 10 minutes to obtain an intermediate layer having a film thickness of 0.7 μm.

Next, crystal-form hydroxygallium phthalocyanine (charge-generating substance) (10 parts) having intensive peaks at a Bragg angle (2θ±0.2°) of 7.5°, 9.9°, 16.3°, 18.6°, 25.1° and 28.3° in CuKα characteristic X-ray diffraction crystal was prepared. To this, cyclohexanone (250 parts) and polyvinyl butyral (trade name: S-LEC, BX-1, manufactured by Sekisui. Chemical Co., Ltd.) (5 parts) were blended and dispersed by a sand mill apparatus using glass beads having a diameter of 1 mm in the atmosphere of 23±3° C. for one hour. After the dispersion, ethyl acetate (250 parts) was added to prepare a charge-generating layer coating liquid. The intermediate layer was dip-coated with the charge-generating layer coating liquid. This was dried at 100° C. for 10 minutes to form a charge-generating layer having a film thickness of 0.26 μm.

Next, a charge-transporting substance (9 parts) having a structure represented by the formula (1-11) above and a charge-transporting substance (1 part) having a structure represented by the formula (1-14) above as the charge-transporting substance; a polycarbonate resin A (1) (3 parts) synthesized in Synthesis Example 1 as the constituent α and a polyester resin (weight average molecular weight 120,000) (7 parts) having a structure represented by the formula (D-1) above as the constituent β were dissolved in a solvent mixture of o-xylene (60 parts) and dimethoxymethane (20 parts) to prepare a charge-transporting layer coating liquid.

The charge-generating layer was dip-coated with the charge-transporting layer coating liquid, dried at 120° C. for one hour to form a charge-transporting layer having a film thickness of 16 μm. It was confirmed that the charge-transporting layer thus formed contains a domain having the constituent α and the matrix containing the constituent β and a charge-transporting substance.

Furthermore, the repeating structural units represented by the formula (D-1) above each has isophthalic acid skeleton and terephthalic acid skeleton in a ratio of 1/1.

In this manner, an electrophotographic photosensitive member having a charge-transporting layer as a surface layer was manufactured. The contents of the constituent α, the constituent β, the charge-transporting substance and the siloxane moiety of a polycarbonate resin A present in the charge-transporting layer and the content of the siloxane moiety of the polycarbonate resin A relative to the total mass of all resins in the charge-transporting layer are shown in Table 3.

Next, evaluation will be described.

Variation in bright-part potential (potential variation) at a during repeated use of 3,000 sheets, a torque relative value at initial time and at the time of repeated use of 3,000 sheets and appearance of the surface of an electrophotographic photosensitive member at the time of measurement of torque were evaluated.

As an evaluation apparatus, a laser beam printer, LBP-2510, manufactured by Canon Inc. was used, which was modified so that charge potential (dark-part potential) of the electrophotographic photosensitive member was controlled. Furthermore, a cleaning blade made of polyurethane rubber was set so as to be contact with the surface of an electrophotographic photosensitive member with a contact angle of 22.5° and a contact pressure of 35 g/cm. Evaluation was made under an environment of a temperature of 23° C. and a relative humidity of 15%.

<Evaluation of Potential Variation>

The amount of exposure (amount of image exposure) by a 780 nm laser light source of an evaluation apparatus was controlled so that the amount of light on the surface of the electrophotographic photosensitive member was 0.3 μJ/cm$^2$. The surface potential (dark-part potential and bright-part potential) of the electrophotographic photosensitive member was measured at the position of a developer by replacing the developer with a jig having a potential measurement probe, which was fixed so as to be positioned at a distance of 130 mm from the end portion of the electrophotographic photosensitive member. The dark-part potential of a non-light exposure section of the electrophotographic photosensitive member was set to be −450V, and then, laser light was applied. In this manner, a bright-part potential obtained by attenuation with light from a dark-part potential was measured. Furthermore, image output was continuously performed by using A4 size plain paper sheets of 3,000. The variation between the bright-part potential before and that after the output was evaluated. As a test chart, a chart having a printing ratio of 4% was used. The results are shown in potential variation in Table 10.

<Evaluation of Torque Relative Value>

In the same conditions as the above conditions for evaluation of potential variation, the driving current value (current value A) of a rotary motor of an electrophotographic photosensitive member was measured. This is an evaluation of contact stress between an electrophotographic photosensitive member and a cleaning blade. The magnitude of the current value represents the magnitude of contact stress between the electrophotographic photosensitive member and the cleaning blade.

Furthermore, an electrophotographic photosensitive member, which provided a torque serving as a reference value based on which relative torque is calculated, was manufactured by the following method. The electrophotographic photosensitive member was manufactured in the same manner as in Example 1 except that a polycarbonate resin A (1), which is the constituent α used in the charge-transporting layer of the electrophotographic photosensitive member of Example 1, was changed to the constituent β described in Table 4, in other words, the constituent β alone was used as the resin. This was used as a control electrophotographic photosensitive member.

Using the control electrophotographic photosensitive member manufactured, the driving current value (current value B) of a rotary motor of the electrophotographic photosensitive member was measured in the same manner as in Example 1.

The ratio of the driving current value (current value A) of a rotary motor of the electrophotographic photosensitive member containing the constituent α according to the present invention and obtained as mentioned above to the control driving current value (current value B) of a rotary motor of the electrophotographic photosensitive member containing no constituent α was computationally obtained. The resultant numerical value of (current value A)/(current value B) was used as a torque relative value for comparison. The numerical value of the torque relative value represents a degree of reduction in contact stress between the electrophotographic photosensitive member using the constituent α and a cleaning blade. The smaller the numerical value of the torque relative value, the larger the degree of reduction in contact stress between the electrophotographic photosensitive member and the cleaning blade. The results are shown in the column of initial torque relative value in Table 10.

Subsequently, 3000 images were continuously output on A4-size plain paper. As a test chart, a chart having a printing ratio of 4% was used. After repeated use of 3,000 paper sheets, measurement for torque relative value was made. The torque relative value after 3,000-sheet repeated use was evaluated in the same manner as in evaluation of the initial torque relative value. In this case, the control electrophotographic photosensitive member was repeatedly used for 3000-sheet image output and the driving current value of a rotary motor was measured at this time to obtain a torque relative value after 3,000-sheet repeated use. The results are shown in the column of torque relative value after 3,000 sheets in Table 10.

<Evaluation of Matrix-Domain Structure>

In the electrophotographic photosensitive member manufactured by the aforementioned method, the charge-transporting layer was sectioned in the vertical direction. The section of the charge-transporting layer was observed by an ultra-high depth shape measurement microscope VK-9500 (manufactured by Keyence Corporation). At the measurement time, the magnification of the object lens was set at 50× and a viewing field of the surface of the electrophotographic photosensitive member was set to be a 100 μm-square (10,000 $\mu m^2$). From the domains observed in the viewing field, 100 domains were selected at random and maximum diameters of the selected domains were obtained through measurement. The maximum diameters were computationally averaged to obtain a number average particle size. The results are shown in Table 10.

Examples 2 to 100

Electrophotographic photosensitive members each were manufactured in the same manner as in Example 1 except that the constituent α, the constituent β and the charge-transporting substance of charge-transporting layer in Example 1 were changed as shown in Tables 5 and 6 and evaluated in the same manner as in Example 1. It was confirmed, in the formed charge-transporting layer, that the matrix, which contains the constituent β and the charge-transporting substance, contains domains containing the constituent α. The results are shown in Table 10.

Further, the weight average molecular weights of polyester resins D used as the constituent β were: (D-1): 120,000.

Furthermore, the repeating structural units represented by the formula (D-1) above each has isophthalic acid skeleton and terephthalic acid skeleton in a ratio of 1/1.

Examples 101 to 150

Electrophotographic photosensitive members each were manufactured in the same manner as in Example 1 except that the constituent α, the constituent β and the charge-transporting substance of the charge-transporting layer in Example 1 were changed as shown in Table 7 and evaluated in the same manner as in Example 1. It was confirmed, in the formed charge-transporting layer, that the matrix, which contains the constituent β and the charge-transporting substance, contains domains containing the constituent α. The results are shown in Table 11.

Further, the weight average molecular weights of polyester resins D used as the constituent β were:

(D-1)/(D-6)=7/3: 150,000

(D-9): 160,000.

Furthermore, the repeating structural units represented by the formulas (D-1) and (D-6) above each has isophthalic acid skeleton and terephthalic acid skeleton in a ratio of 1/1.

Note that in Examples 115 to 128, the copolymerization ratio of the repeating structural unit present in the resin forming the constituent β.

Examples 151 to 207

Electrophotographic photosensitive members each were manufactured in the same manner as in Example 1 except that the constituent α, the constituent β and the charge-transporting substance of charge-transporting layer in Example 1 were changed as shown in Table 8 and evaluated in the same manner as in Example 1. It was confirmed, in the formed charge-transporting layer, that the matrix, which contains the constituent β and the charge-transporting substance, contains domains containing the constituent α. The results are shown in Table 11.

Further, the weight average molecular weight of a polyester resin D used as the constituent β was:

(D-2): 120,000

(D-10): 155,000

(D-5): 140,000.

Furthermore, the repeating structural units represented by the formulas (D-2) and (D-5) above each has isophthalic acid skeleton and terephthalic acid skeleton in a ratio of 3/7.

Furthermore, the weight average molecular weight of polycarbonate resins represented by the formulas (2-1) and (2-1) above, which were additionally blended as the constituent β other than a resin D were:

(2-1): 70,000

(2-2): 60,000.

Comparative Examples

As a comparative resin, a resin F (a polycarbonate resin F) shown in Table 4 was synthesized in place of a polycarbonate resin A.

TABLE 4

| Polycarbonate resin F | Repeating structural unit represented by formula (A) | Repeating structural unit represented by the formula (B) | Repeating structural unit represented by the formula (C) | Content of siloxane moiety in polycarbonate resin A (% by mass) | Content of the formula (B) in polycarbonate resin (% by mass) | Content of the formula (C) in polycarbonate resin (% by mass) | Weight average molecular weight (Mw) |
|---|---|---|---|---|---|---|---|
| Resin F(1) | (A-4) | (B-1) | (C) | 2 | 10 | 88 | 56000 |
| Resin F(2) | (A-2) | (B-1) | (C) | 50 | 20 | 23 | 68000 |
| Resin F(3) | (A-1) | (B-1) | (C) | 20 | 5 | 71 | 67000 |
| Resin F(4) | (A-1) | (B-1) | (C) | 20 | 50 | 26 | 71000 |
| Resin F(5) | (A-1) | (B-2) | (C) | 20 | 5 | 71 | 59000 |
| Resin F(6) | (A-3) | — | (C) | 20 | — | 78 | 73000 |
| Resin F(7) | (A-7) | — | (C) | 20 | — | 79 | 76000 |

Comparative Example 1

An electrophotographic photosensitive member was manufactured in the same manner as in Example 1 except that a polycarbonate resin A (1) in Example 1 was changed to a resin F (1) shown in Table 4 above and changes shown in Table 9 were made. The constitution of the resins contained in the charge-transporting layer and the content of a siloxane moiety are shown in Table 9. Evaluation was made in the same manner as in Example 1 and the results are shown in Table 12. A matrix-domain structure was not confirmed in the charge-transporting layer formed.

Comparative Examples 2 to 6, 15 to 20 and 27 to 36

Electrophotographic photosensitive members each were manufactured in the same manner as in Example 1 except that a polycarbonate resin A (1) in Example 1 was changed to a resin F (1) shown in Table 4 above and changes shown in Table 9 were made. The constitution of the resins contained in the charge-transporting layer and the content of a siloxane moiety are shown in Table 9. Evaluation was made in the same manner as in Example 1 and the results are shown in Table 12. A matrix-domain structure was not confirmed in the charge-transporting layer formed.

Comparative Examples 7 and 14

Electrophotographic photosensitive members each were manufactured in the same manner as in Example 1 except that resin F alone shown in Table 4 was contained as a resin to be contained in the charge-transporting layer. The constitution of the resins contained in the charge-transporting layer and the content of a siloxane moiety are shown in Table 9. Evaluation was made in the same manner as in Example 1 and the results are shown in Table 12. A matrix-domain structure was not confirmed in the charge-transporting layer formed. Note that the electrophotographic photosensitive member used as a control for torque relative value is the control electrophotographic photosensitive member used in Example 1.

Comparative Examples 8 to 13 and 21 to 26

Electrophotographic photosensitive members each were manufactured in the same manner as in Example 1 except that a polycarbonate resin A (1) in Example 1 was changed to a resin F shown in Table 4 above and changes shown in Table 9 were made. The constitution of the resins contained in the charge-transporting layer and the content of a siloxane moiety are shown in Table 9. Evaluation was made in the same manner as in Example 1 and the results are shown in Table 12. A matrix-domain structure was formed in the charge-transporting layer formed; however the domains were all large and nonuniform.

Comparative Examples 37 and 38

Electrophotographic photosensitive members each were manufactured in the same manner as in Example 1 except that a polycarbonate resin A (15) in Example 1 was changed to polycarbonate resin F (8), which is the same resin as resin A (15) except that the repeating structural unit (A-2) was changed to that represented by the following formula (A-13), and changes shown in Table 9 were made. The constitution of the resins contained in the charge-transporting layer and the content of a siloxane moiety are shown in Table 9. Evaluation was made in the same manner as in Example 1 and the results are shown in Table 12. A matrix-domain structure was not confirmed in the charge-transporting layer formed. Note that numerical value representing the number of repetitions of the siloxane moiety in the repeating structural unit represented by the following formula (A-13) represents the average value of the number of repetitions. In this case, the average value of the number of repetitions of the siloxane moiety in the repeating structural unit represented by the following formula (A-13) in resin F (8) was 10.

(A-13)

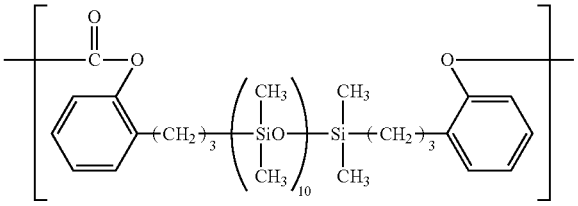

Comparative Examples 39 and 40

Electrophotographic photosensitive members each were manufactured in the same manner as in Example 1 except that a polycarbonate resin A (15) in Example 1 was changed to polycarbonate resin F (9), which is the same resin as resin A (15) except that the repeating structural unit (A-2) was changed to that represented by the following formula (A-14), and changes shown in Table 9 were made. The constitution of the resins contained in the charge-transporting layer and the content of a siloxane moiety are shown in Table 9. Evaluation was made in the same manner as in Example 1 and the results are shown in Table 12. A matrix-domain structure was formed in the charge-transporting layer formed; however the domains were all large and nonuniform. Note that the electrophotographic photosensitive member used as a control for torque relative value is the control electrophotographic photosensitive member used in Example 1. Note that numerical value representing the number of repetitions of the siloxane moiety in the repeating structural unit represented by the following formula (A-14) represents the average value of the number of repetitions. In this case, the average value of the number of repetitions of the siloxane moiety in the repeating structural unit represented by the following formula (A-14) in resin F (9) was 70.

(A-14)

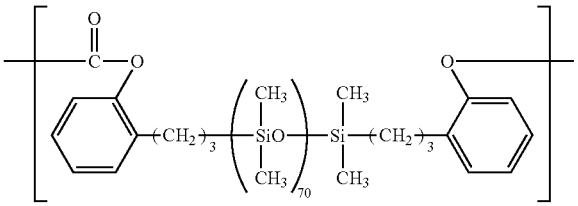

Comparative Examples 41 to 46

Electrophotographic photosensitive members each were manufactured in the same manner as in Example 1 except that a polycarbonate resin A (1) in Example 1 was changed to a resin (G (1): weight average molecular weight of 60,000) containing the repeating structural unit represented by the following formula (G) (structure described in Patent Literature 1), the repeating structural unit represented by the formula (D-1) above and having the content of a siloxane moiety in the resin of 30% by mass; and changes shown in Table 9 were made. The constitution of the resins contained in the charge-transporting layer and the content of a siloxane moiety are shown in Table 9. Evaluation was made in the same manner as in Example 1 and the results are shown in Table 12. A matrix-domain structure was formed in the charge-transporting layer formed. Note that the electrophotographic photosensitive member used as a control for torque relative value is the control electrophotographic photosensitive member used in Example 1. Note that numerical value representing the number of repetitions of the siloxane moiety in the repeating structural unit represented by the following formula (G) represents the average value of the number of repetitions. In this case, average value of the number of repetitions of the siloxane moiety in the repeating structural unit represented by the following formula (G) in the resin G (1) was 40.

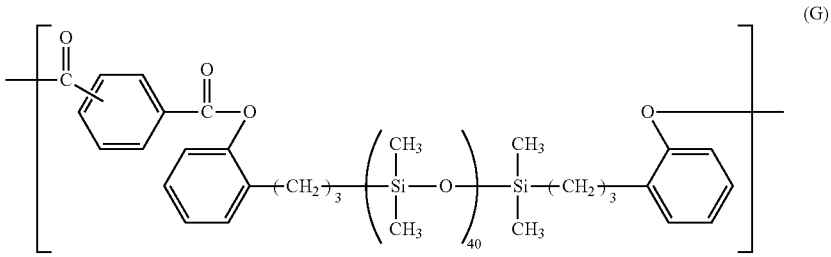

(G)

Comparative Examples 47 to 52

Electrophotographic photosensitive members each were manufactured in the same manner as in Example 1 except that a polycarbonate resin A (15) in Example 1 was changed to a polycarbonate resin F (10), which is the same resin as resin A (15) except that the repeating structural unit represented by the formula (C) above was changed to the repeating structural unit represented by the formula (2-3), and changes shown in Table 9 were made. The constitution of the resins contained in the charge-transporting layer and the content of a siloxane moiety are shown in Table 9. Evaluation was made in the same manner as in Example 1 and the results are shown in Table 12. A matrix-domain structure was not confirmed in the charge-transporting layer formed. A matrix-domain structure was not confirmed in the charge-transporting layer thus formed.

Comparative Examples 53 to 57

Electrophotographic photosensitive members each were manufactured in the same manner as in Example 1 except that the constituent α, the constituent β and the charge-transporting substance of the charge-transporting layer in Example 1 were changed as shown in Table 9 and evaluation was made in the same manner as in Example 1. The results are shown in Table 12. A matrix-domain structure was not confirmed in the charge-transporting layer formed. Note that repeating structural units of the polyester resin used as the constituent β are shown in Formulas (3-1), (3-2) and (3-3) below. Note that the weight average molecular weights of polyester resins used as the constituent β were:

(3-1): 120,000

(3-2): 125,000

(3-3): 130,000.

Furthermore, the repeating structural units represented by the formulas (3-2) and (3-3) below have isophthalic acid skeleton and terephthalic acid skeleton in a ratio of 1/1.

(3-1)

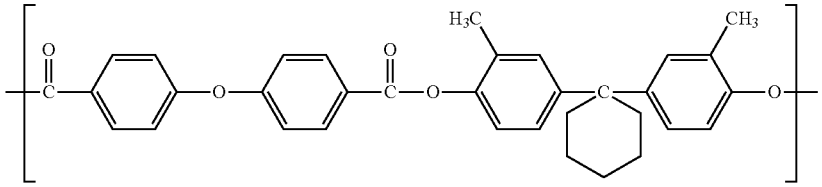

(3-2)

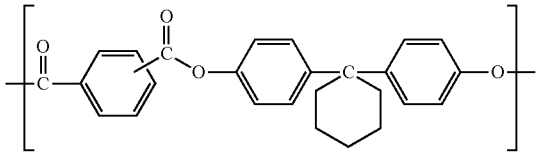

(3-3)

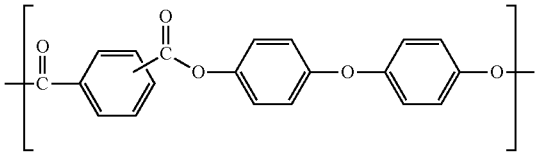

Comparative Examples 58 to 61

Electrophotographic photosensitive members each were manufactured in the same manner as in Example 1 except that the constituent α, the constituent β and the charge-transporting substance of the charge-transporting layer in Example 1 were changed as shown in Table 9 and evaluation was made in the same manner as in Example 1. The results are shown in Table 12. In Comparative Examples 58 and 60, a matrix-domain structure was not confirmed in the charge-transporting layer formed. In Comparative Examples 59 and 61, a matrix-domain structure was formed in the charge-transporting layer formed; however the domains were both large and nonuniform.

entry refers to the types of charge-transporting substances and the blending ratio thereof. In Tables 5 to 8, each entry in the column "Component [α]" refers to the composition of the constituent α. In Tables 5 to 8, each entry in the column "Siloxane content A (% by mass)" refers to the content of a siloxane moiety (% by mass) in a polycarbonate resin A. In Tables 5 to 8, each entry in the column "Component [β]" refers to the composition of the constituent β. In Tables 5 to 8, each entry in the column "Blending ratio of Component [α] and Component [β]" refers to a blending ratio of the constituent α and the constituent β in a charge-transporting layer (the constituent α/the constituent β). In Tables 5 to 8, each entry in the column "Siloxane content B (% by mass)" refers to the content of a siloxane moiety (% by mass) in the polycarbonate resin A relative to the total mass of resins in the charge-transporting layer. For Examples 171 to 187 in Table 8, the numbers (parts) of the formula (D) and the formula (2) in the column of "Component [β]" each represent a blending amount of resins.

TABLE 5

| | Charge-transporting substance | Component [α] | Siloxane content A (% by mass) | Component [β] | Blending ratio of Component [α] to Component [β] | Siloxane content B (% by mass) |
|---|---|---|---|---|---|---|
| Example 1 | (1-11)/(1-14) = 7/3 | Resin A (1) | 40 | (D-1) | 3/7 | 12 |
| Example 2 | (1-11)/(1-14) = 9/1 | Resin A (1) | 40 | (D-1) | 6/4 | 16 |
| Example 3 | (1-11)/(1-14) = 9/1 | Resin A (1) | 40 | (D-1) | 2/8 | 8 |
| Example 4 | (1-11)/(1-13) = 9/1 | Resin A (1) | 40 | (D-1) | 3/7 | 12 |
| Example 5 | (1-15) | Resin A (1) | 40 | (D-1) | 3/7 | 12 |
| Example 6 | (1-17) | Resin A (1) | 40 | (D-1) | 3/7 | 12 |
| Example 7 | (1-11)/(1-14) = 7/3 | Resin A (2) | 30 | (D-1) | 5/5 | 15 |
| Example 8 | (1-11)/(1-14) = 9/1 | Resin A (2) | 30 | (D-1) | 3/7 | 9 |
| Example 9 | (1-11)/(1-14) = 9/1 | Resin A (2) | 30 | (D-1) | 2/8 | 6 |
| Example 10 | (1-11)/(1-13) = 9/1 | Resin A (2) | 30 | (D-1) | 3/7 | 9 |
| Example 11 | (1-1) | Resin A (2) | 30 | (D-1) | 3/7 | 9 |
| Example 12 | (1-17) | Resin A (2) | 30 | (D-1) | 3/7 | 9 |
| Example 13 | (1-11)/(1-14) = 9/1 | Resin A (3) | 18 | (D-1) | 3/7 | 5 |
| Example 14 | (1-11)/(1-14) = 9/1 | Resin A (3) | 18 | (D-1) | 4/6 | 7 |
| Example 15 | (1-1) | Resin A (3) | 18 | (D-1) | 2/8 | 4 |
| Example 16 | (1-11)/(1-13) = 9/1 | Resin A (3) | 18 | (D-1) | 3/7 | 5 |
| Example 17 | (1-11)/(1-14) = 7/3 | Resin A (3) | 18 | (D-1) | 5/5 | 9 |
| Example 18 | (1-15) | Resin A (3) | 18 | (D-1) | 1/9 | 2 |
| Example 19 | (1-7)/(1-6) = 5/5 | Resin A (3) | 18 | (D-1) | 5/5 | 9 |
| Example 20 | (1-5) | Resin A (3) | 18 | (D-1) | 2/8 | 4 |
| Example 21 | (1-11)/(1-14) = 7/3 | Resin A (4) | 10 | (D-1) | 3/7 | 3 |
| Example 22 | (1-15) | Resin A (4) | 10 | (D-1) | 5/5 | 5 |
| Example 23 | (1-3) | Resin A (4) | 10 | (D-1) | 2/8 | 2 |
| Example 24 | (1-17) | Resin A (5) | 5 | (D-1) | 3/7 | 2 |
| Example 25 | (1-11)/(1-13) = 9/1 | Resin A (5) | 5 | (D-1) | 5/5 | 3 |
| Example 26 | (1-11)/(1-14) = 7/3 | Resin A (5) | 5 | (D-1) | 2/8 | 1 |
| Example 27 | (1-17) | Resin A (6) | 5 | (D-1) | 3/7 | 2 |
| Example 28 | (1-11)/(1-13) = 9/1 | Resin A (6) | 5 | (D-1) | 5/5 | 3 |
| Example 29 | (1-11)/(1-14) = 7/3 | Resin A (6) | 5 | (D-1) | 2/8 | 1 |
| Example 30 | (1-11)/(1-14) = 7/3 | Resin A (7) | 40 | (D-1) | 5/5 | 20 |
| Example 31 | (1-11)/(1-14) = 7/3 | Resin A (7) | 40 | (D-1) | 3/7 | 12 |
| Example 32 | (1-3) | Resin A (7) | 40 | (D-1) | 1/9 | 4 |
| Example 33 | (1-17) | Resin A (8) | 5 | (D-1) | 3/7 | 2 |
| Example 34 | (1-11)/(1-13) = 9/1 | Resin A (8) | 5 | (D-1) | 5/5 | 3 |
| Example 35 | (1-11)/(1-14) = 7/3 | Resin A (8) | 5 | (D-1) | 2/8 | 1 |
| Example 36 | (1-11)/(1-14) = 7/3 | Resin A (9) | 40 | (D-1) | 5/5 | 20 |
| Example 37 | (1-11)/(1-14) = 7/3 | Resin A (9) | 40 | (D-1) | 3/7 | 12 |
| Example 38 | (1-5) | Resin A (9) | 40 | (D-1) | 1/9 | 4 |
| Example 39 | (1-15) | Resin A (10) | 40 | (D-1) | 5/5 | 20 |
| Example 40 | (1-3) | Resin A (10) | 40 | (D-1) | 3/7 | 12 |
| Example 41 | (1-17) | Resin A (10) | 40 | (D-1) | 1/9 | 4 |
| Example 42 | (1-11)/(1-13) = 9/1 | Resin A (11) | 30 | (D-1) | 5/5 | 15 |
| Example 43 | (1-11)/(1-14) = 7/3 | Resin A (11) | 30 | (D-1) | 3/7 | 9 |
| Example 44 | (1-11)/(1-14) = 7/3 | Resin A (11) | 30 | (D-1) | 1/9 | 3 |
| Example 45 | (1-17) | Resin A (12) | 5 | (D-1) | 3/7 | 2 |
| Example 46 | (1-11)/(1-13) = 9/1 | Resin A (12) | 5 | (D-1) | 5/5 | 3 |
| Example 47 | (1-11)/(1-14) = 7/3 | Resin A (12) | 5 | (D-1) | 2/8 | 1 |
| Example 48 | (1-15) | Resin A (13) | 40 | (D-1) | 5/5 | 20 |
| Example 49 | (1-3) | Resin A (13) | 40 | (D-1) | 3/7 | 12 |
| Example 50 | (1-17) | Resin A (13) | 40 | (D-1) | 1/9 | 4 |

In Tables 5 to 8, each entry in the column "Charge-transporting substance" refers to the charge-transporting substance contained in the charge-transporting layer. When the charge-transporting substances are blended and used, the

TABLE 6

| | Charge-transporting substance | Component [α] | Siloxane content A (% by mass) | Component [β] | Blending ratio of Component [α] to Component [β] | Siloxane content B (% by mass) |
|---|---|---|---|---|---|---|
| Example 51 | (1-11)/(1-14) = 7/3 | Resin A (14) | 40 | (D-1) | 5/5 | 20 |
| Example 52 | (1-5) | Resin A (14) | 40 | (D-1) | 3/7 | 12 |
| Example 53 | (1-15) | Resin A (14) | 40 | (D-1) | 1/9 | 4 |
| Example 54 | (1-11)/(1-14) = 7/3 | Resin A (15) | 20 | (D-1) | 3/7 | 6 |
| Example 55 | (1-11)/(1-14) = 7/3 | Resin A (15) | 20 | (D-1) | 5/5 | 10 |
| Example 56 | (1-17) | Resin A (16) | 5 | (D-1) | 5/5 | 3 |
| Example 57 | (1-11)/(1-14) = 7/3 | Resin A (16) | 5 | (D-1) | 2/8 | 1 |
| Example 58 | (1-17) | Resin A (17) | 40 | (D-1) | 1/9 | 4 |
| Example 59 | (1-11)/(1-14) = 7/3 | Resin A (17) | 40 | (D-1) | 5/5 | 20 |
| Example 60 | (1-5) | Resin A (17) | 40 | (D-1) | 3/7 | 12 |
| Example 61 | (1-11)/(1-14) = 7/3 | Resin A (18) | 40 | (D-1) | 1/9 | 4 |
| Example 62 | (1-11)/(1-14) = 7/3 | Resin A (18) | 40 | (D-1) | 5/5 | 20 |
| Example 63 | (1-17) | Resin A (18) | 40 | (D-1) | 3/7 | 12 |
| Example 64 | (1-11)/(1-14) = 7/3 | Resin A (19) | 20 | (D-1) | 3/7 | 6 |
| Example 65 | (1-11)/(1-14) = 7/3 | Resin A (19) | 20 | (D-1) | 5/5 | 10 |
| Example 66 | (1-17) | Resin A (20) | 5 | (D-1) | 5/5 | 3 |
| Example 67 | (1-11)/(1-14) = 7/3 | Resin A (20) | 5 | (D-1) | 2/8 | 1 |
| Example 68 | (1-11)/(1-14) = 7/3 | Resin A (21) | 40 | (D-1) | 1/9 | 4 |
| Example 69 | (1-11)/(1-14) = 7/3 | Resin A (21) | 40 | (D-1) | 5/5 | 20 |
| Example 70 | (1-7)/(1-6) = 5/5 | Resin A (21) | 40 | (D-1) | 3/7 | 12 |
| Example 71 | (1-11)/(1-14) = 7/3 | Resin A (22) | 40 | (D-1) | 5/5 | 20 |
| Example 72 | (1-7)/(1-6) = 5/5 | Resin A (22) | 40 | (D-1) | 3/7 | 12 |
| Example 73 | (1-11)/(1-13) = 9/1 | Resin A (23) | 20 | (D-1) | 3/7 | 6 |
| Example 74 | (1-11)/(1-14) = 7/3 | Resin A (23) | 20 | (D-1) | 5/5 | 10 |
| Example 75 | (1-11)/(1-14) = 7/3 | Resin A (24) | 5 | (D-1) | 5/5 | 3 |
| Example 76 | (1-5) | Resin A (24) | 5 | (D-1) | 2/8 | 1 |
| Example 77 | (1-11)/(1-14) = 7/3 | Resin A (25) | 40 | (D-1) | 5/5 | 20 |
| Example 78 | (1-7)/(1-6) = 5/5 | Resin A (25) | 40 | (D-1) | 3/7 | 12 |
| Example 79 | (1-5) | Resin A (26) | 40 | (D-1) | 5/5 | 20 |
| Example 80 | (1-15) | Resin A (26) | 40 | (D-1) | 3/7 | 12 |
| Example 81 | (1-7)/(1-6) = 5/5 | Resin A (27) | 20 | (D-1) | 3/7 | 6 |
| Example 82 | (1-5) | Resin A (27) | 20 | (D-1) | 5/5 | 10 |
| Example 83 | (1-15) | Resin A (28) | 5 | (D-1) | 5/5 | 3 |
| Example 84 | (1-7)/(1-6) = 5/5 | Resin A (28) | 5 | (D-1) | 2/8 | 1 |
| Example 85 | (1-5) | Resin A (29) | 40 | (D-1) | 5/5 | 20 |
| Example 86 | (1-15) | Resin A (29) | 40 | (D-1) | 3/7 | 12 |
| Example 87 | (1-7)/(1-6) = 5/5 | Resin A (30) | 20 | (D-1) | 3/7 | 6 |
| Example 88 | (1-7)/(1-6) = 5/5 | Resin A (31) | 20 | (D-1) | 3/7 | 6 |
| Example 89 | (1-11)/(1-14) = 7/3 | Resin A (32) | 40 | (D-1) | 1/9 | 4 |
| Example 90 | (1-11)/(1-14) = 7/3 | Resin A (32) | 40 | (D-1) | 5/5 | 20 |
| Example 91 | (1-11)/(1-13) = 9/1 | Resin A (32) | 40 | (D-1) | 3/7 | 12 |
| Example 92 | (1-11)/(1-14) = 9/1 | Resin A (33) | 19 | (D-1) | 3/7 | 6 |
| Example 93 | (1-11)/(1-13) = 9/1 | Resin A (33) | 19 | (D-1) | 3/7 | 6 |
| Example 94 | (1-11)/(1-14) = 7/3 | Resin A (33) | 19 | (D-1) | 4/6 | 8 |
| Example 95 | (1-11)/(1-14) = 7/3 | Resin A (33) | 19 | (D-1) | 2/8 | 4 |
| Example 96 | (1-15) | Resin A (33) | 19 | (D-1) | 3/7 | 6 |
| Example 97 | (1-11)/(1-14) = 7/3 | Resin A (33) | 19 | (D-1) | 5/5 | 10 |
| Example 98 | (1-11)/(1-14) = 7/3 | Resin A (33) | 19 | (D-1) | 1/9 | 2 |
| Example 99 | (1-11)/(1-14) = 7/3 | Resin A (34) | 5 | (D-1) | 5/5 | 3 |
| Example 100 | (1-11)/(1-14) = 7/3 | Resin A (34) | 5 | (D-1) | 2/8 | 1 |

TABLE 7

| | Charge-transporting substance | Component [α] | Siloxane content A (% by mass) | Component [β] | Blending ratio of Component [α] to Component [β] | Siloxane content B (% by mass) |
|---|---|---|---|---|---|---|
| Example 101 | (1-11)/(1-14) = 7/3 | Resin A (35) | 40 | (D-1) | 5/5 | 20 |
| Example 102 | (1-11)/(1-14) = 7/3 | Resin A (35) | 40 | (D-1) | 1/9 | 4 |
| Example 103 | (1-7)/(1-6) = 5/5 | Resin A (36) | 20 | (D-1) | 3/7 | 6 |
| Example 104 | (1-5) | Resin A (36) | 20 | (D-1) | 5/5 | 10 |
| Example 105 | (1-7)/(1-6) = 5/5 | Resin A (37) | 20 | (D-1) | 3/7 | 6 |
| Example 106 | (1-5) | Resin A (37) | 20 | (D-1) | 5/5 | 10 |
| Example 107 | (1-11)/(1-13) = 9/1 | Resin A (38) | 20 | (D-1) | 3/7 | 6 |
| Example 108 | (1-11)/(1-13) = 9/1 | Resin A (38) | 20 | (D-1) | 5/5 | 10 |
| Example 109 | (1-15) | Resin A (39) | 20 | (D-1) | 5/5 | 10 |
| Example 110 | (1-11)/(1-14) = 7/3 | Resin A (39) | 20 | (D-1) | 3/7 | 6 |
| Example 111 | (1-11)/(1-14) = 7/3 | Resin A (39) | 20 | (D-1) | 1/9 | 1 |
| Example 112 | (1-15) | Resin A (40) | 20 | (D-1) | 5/5 | 10 |
| Example 113 | (1-11)/(1-14) = 7/3 | Resin A (40) | 20 | (D-1) | 3/7 | 6 |
| Example 114 | (1-11)/(1-14) = 7/3 | Resin A (40) | 20 | (D-1) | 1/9 | 1 |
| Example 115 | (1-11)/(1-14) = 7/3 | Resin A (3) | 18 | (D-1)/(D-6) = 7/3 | 5/5 | 9 |
| Example 116 | (1-11)/(1-14) = 7/3 | Resin A (3) | 18 | (D-1)/(D-6) = 7/3 | 3/7 | 5 |

TABLE 7-continued

| | Charge-transporting substance | Component [α] | Siloxane content A (% by mass) | Component [β] | Blending ratio of Component [α] to Component [β] | Siloxane content B (% by mass) |
|---|---|---|---|---|---|---|
| Example 117 | (1-11)/(1-14) = 7/3 | Resin A (7) | 40 | (D-1)/(D-6) = 7/3 | 3/7 | 12 |
| Example 118 | (1-11)/(1-14) = 7/3 | Resin A (7) | 40 | (D-1)/(D-6) = 7/3 | 2/8 | 8 |
| Example 119 | (1-11)/(1-14) = 7/3 | Resin A (8) | 5 | (D-1)/(D-6) = 7/3 | 5/5 | 3 |
| Example 120 | (1-11)/(1-14) = 7/3 | Resin A (15) | 20 | (D-1)/(D-6) = 7/3 | 3/7 | 6 |
| Example 121 | (1-11)/(1-14) = 7/3 | Resin A (15) | 20 | (D-1)/(D-6) = 7/3 | 2/8 | 2 |
| Example 122 | (1-11)/(1-14) = 7/3 | Resin A (19) | 20 | (D-1)/(D-6) = 7/3 | 3/7 | 6 |
| Example 123 | (1-11)/(1-14) = 7/3 | Resin A (19) | 20 | (D-1)/(D-6) = 7/3 | 2/8 | 2 |
| Example 124 | (1-11)/(1-14) = 7/3 | Resin A (26) | 40 | (D-1)/(D-6) = 7/3 | 3/7 | 12 |
| Example 125 | (1-11)/(1-14) = 7/3 | Resin A (26) | 40 | (D-1)/(D-6) = 7/3 | 2/8 | 8 |
| Example 126 | (1-11)/(1-14) = 7/3 | Resin A (33) | 19 | (D-1)/(D-6) = 7/3 | 3/7 | 6 |
| Example 127 | (1-11)/(1-14) = 7/3 | Resin A (33) | 19 | (D-1)/(D-6) = 7/3 | 2/8 | 2 |
| Example 128 | (1-11)/(1-13) = 9/1 | Resin A (33) | 19 | (D-1)/(D-6) = 7/3 | 3/7 | 9 |
| Example 129 | (1-11)/(1-14) = 7/3 | Resin A (3) | 18 | (D-9) | 3/7 | 5 |
| Example 130 | (1-11)/(1-14) = 7/3 | Resin A (7) | 40 | (D-9) | 3/7 | 12 |
| Example 131 | (1-11)/(1-14) = 7/3 | Resin A (7) | 40 | (D-9) | 2/8 | 8 |
| Example 132 | (1-11)/(1-14) = 7/3 | Resin A (8) | 5 | (D-9) | 5/5 | 3 |
| Example 133 | (1-11)/(1-14) = 7/3 | Resin A (15) | 20 | (D-9) | 3/7 | 6 |
| Example 134 | (1-11)/(1-14) = 7/3 | Resin A (15) | 20 | (D-9) | 2/8 | 2 |
| Example 135 | (1-11)/(1-14) = 7/3 | Resin A (19) | 20 | (D-9) | 3/7 | 6 |
| Example 136 | (1-11)/(1-14) = 7/3 | Resin A (19) | 20 | (D-9) | 2/8 | 2 |
| Example 137 | (1-11)/(1-14) = 7/3 | Resin A (26) | 40 | (D-9) | 3/7 | 12 |
| Example 138 | (1-11)/(1-14) = 7/3 | Resin A (26) | 40 | (D-9) | 2/8 | 8 |
| Example 139 | (1-11)/(1-14) = 7/3 | Resin A (33) | 19 | (D-9) | 3/7 | 6 |
| Example 140 | (1-11)/(1-14) = 7/3 | Resin A (33) | 19 | (D-9) | 2/8 | 2 |
| Example 141 | (1-11)/(1-13) = 9/1 | Resin A (3) | 18 | (D-9) | 5/5 | 9 |
| Example 142 | (1-11)/(1-13) = 9/1 | Resin A (3) | 18 | (D-9) | 3/7 | 5 |
| Example 143 | (1-11)/(1-13) = 9/1 | Resin A (7) | 40 | (D-9) | 3/7 | 12 |
| Example 144 | (1-11)/(1-13) = 9/1 | Resin A (8) | 5 | (D-9) | 5/5 | 3 |
| Example 145 | (1-11)/(1-13) = 9/1 | Resin A (15) | 20 | (D-9) | 3/7 | 6 |
| Example 146 | (1-11)/(1-13) = 9/1 | Resin A (19) | 20 | (D-9) | 3/7 | 6 |
| Example 147 | (1-11)/(1-13) = 9/1 | Resin A (26) | 40 | (D-9) | 3/7 | 12 |
| Example 148 | (1-11)/(1-13) = 9/1 | Resin A (26) | 40 | (D-9) | 2/8 | 8 |
| Example 149 | (1-11)/(1-13) = 9/1 | Resin A (33) | 19 | (D-9) | 3/7 | 6 |
| Example 150 | (1-11)/(1-13) = 9/1 | Resin A (33) | 19 | (D-9) | 2/8 | 2 |

TABLE 8

| | Charge-transporting substance | Component [α] | Siloxane content A (% by mass) | Component [β] | Blending ratio of Component [α] to Component [β] | Siloxane content B (% by mass) |
|---|---|---|---|---|---|---|
| Example 151 | (1-15) | Resin A (3) | 18 | (D-2) | 5/5 | 9 |
| Example 152 | (1-15) | Resin A (3) | 18 | (D-2) | 3/7 | 5 |
| Example 153 | (1-15) | Resin A (7) | 40 | (D-2) | 3/7 | 12 |
| Example 154 | (1-15) | Resin A (8) | 5 | (D-2) | 5/5 | 3 |
| Example 155 | (1-15) | Resin A (15) | 20 | (D-2) | 3/7 | 6 |
| Example 156 | (1-15) | Resin A (19) | 20 | (D-2) | 3/7 | 6 |
| Example 157 | (1-15) | Resin A (26) | 40 | (D-2) | 3/7 | 12 |
| Example 158 | (1-15) | Resin A (26) | 40 | (D-2) | 2/8 | 8 |
| Example 159 | (1-15) | Resin A (33) | 19 | (D-2) | 3/7 | 6 |
| Example 160 | (1-15) | Resin A (33) | 19 | (D-2) | 2/8 | 2 |
| Example 161 | (1-15) | Resin A (3) | 18 | (D-10) | 5/5 | 9 |
| Example 162 | (1-15) | Resin A (3) | 18 | (D-10) | 3/7 | 5 |
| Example 163 | (1-15) | Resin A (7) | 40 | (D-10) | 3/7 | 12 |
| Example 164 | (1-15) | Resin A (8) | 5 | (D-10) | 5/5 | 3 |
| Example 165 | (1-15) | Resin A (15) | 20 | (D-10) | 3/7 | 6 |
| Example 166 | (1-15) | Resin A (19) | 20 | (D-10) | 3/7 | 6 |
| Example 167 | (1-15) | Resin A (26) | 40 | (D-10) | 3/7 | 12 |
| Example 168 | (1-15) | Resin A (26) | 40 | (D-10) | 2/8 | 8 |
| Example 169 | (1-15) | Resin A (33) | 19 | (D-10) | 3/7 | 6 |
| Example 170 | (1-15) | Resin A (33) | 19 | (D-10) | 2/8 | 2 |
| Example 171 | (1-11)/(1-14) = 9/1 | Resin A (3) | 18 | (D-1)9 parts, (2-1)1 part | 5/5 | 9 |
| Example 172 | (1-11)/(1-14) = 7/3 | Resin A (3) | 18 | (D-1)9 parts, (2-1)1 part | 3/7 | 5 |
| Example 173 | (1-11)/(1-14) = 9/1 | Resin A (7) | 40 | (D-1)9 parts, (2-1)1 part | 3/7 | 12 |
| Example 174 | (1-11)/(1-14) = 9/1 | Resin A (7) | 40 | (D-1)9 parts, (2-1)1 part | 2/8 | 8 |
| Example 175 | (1-11)/(1-13) = 9/1 | Resin A (8) | 5 | (D-1)9 parts, (2-1)1 part | 5/5 | 3 |
| Example 176 | (1-11)/(1-14) = 9/1 | Resin A (15) | 20 | (D-1)9 parts, (2-1)1 part | 3/7 | 6 |
| Example 177 | (1-11)/(1-14) = 7/3 | Resin A (15) | 20 | (D-1)9 parts, (2-1)1 part | 2/8 | 2 |
| Example 178 | (1-11)/(1-14) = 9/1 | Resin A (19) | 20 | (D-1)9 parts, (2-1)1 part | 3/7 | 6 |
| Example 179 | (1-11)/(1-14) = 9/1 | Resin A (19) | 20 | (D-1)9 parts, (2-1)1 part | 2/8 | 2 |
| Example 180 | (1-11)/(1-14) = 9/1 | Resin A (26) | 40 | (D-1)9 parts, (2-1)1 part | 3/7 | 12 |
| Example 181 | (1-11)/(1-14) = 9/1 | Resin A (26) | 40 | (D-1)9 parts, (2-1)1 part | 2/8 | 8 |

TABLE 8-continued

| | Charge-transporting substance | Component [α] | Siloxane content A (% by mass) | Component [β] | Blending ratio of Component [α] to Component [β] | Siloxane content B (% by mass) |
|---|---|---|---|---|---|---|
| Example 182 | (1-11)/(1-14) = 9/1 | Resin A (33) | 19 | (D-1)9 parts, (2-1)1 part | 3/7 | 6 |
| Example 183 | (1-11)/(1-14) = 7/3 | Resin A (33) | 19 | (D-1)9 parts, (2-1)1 part | 2/8 | 2 |
| Example 184 | (1-11)/(1-14) = 7/3 | Resin A (32) | 40 | (D-10)9 parts, (2-2)1 part | 3/7 | 12 |
| Example 185 | (1-11)/(1-13) = 9/1 | Resin A (34) | 5 | (D-10)9 parts, (2-2)1 part | 5/5 | 3 |
| Example 186 | (1-15) | Resin A (33) | 19 | (D-2)9 parts, (2-2)1 part | 3/7 | 6 |
| Example 187 | (1-15) | Resin A (33) | 19 | (D-5)9 parts, (2-2)1 part | 2/8 | 2 |
| Example 188 | (1-15) | Resin A (3) | 18 | (D-5) | 5/5 | 9 |
| Example 189 | (1-15) | Resin A (3) | 18 | (D-5) | 3/7 | 5 |
| Example 190 | (1-15) | Resin A (7) | 40 | (D-5) | 3/7 | 12 |
| Example 191 | (1-15) | Resin A (8) | 5 | (D-5) | 5/5 | 3 |
| Example 192 | (1-15) | Resin A (15) | 20 | (D-5) | 3/7 | 6 |
| Example 193 | (1-15) | Resin A (19) | 20 | (D-5) | 3/7 | 6 |
| Example 194 | (1-15) | Resin A (26) | 40 | (D-5) | 3/7 | 12 |
| Example 195 | (1-15) | Resin A (26) | 40 | (D-5) | 2/8 | 8 |
| Example 196 | (1-15) | Resin A (33) | 19 | (D-5) | 3/7 | 6 |
| Example 197 | (1-15) | Resin A (33) | 19 | (D-5) | 2/8 | 2 |
| Example 198 | (1-17) | Resin A (3) | 18 | (D-5) | 5/5 | 9 |
| Example 199 | (1-17) | Resin A (3) | 18 | (D-5) | 3/7 | 5 |
| Example 200 | (1-17) | Resin A (7) | 40 | (D-2) | 3/7 | 12 |
| Example 201 | (1-17) | Resin A (8) | 5 | (D-2) | 5/5 | 3 |
| Example 202 | (1-17) | Resin A (15) | 20 | (D-10) | 3/7 | 6 |
| Example 203 | (1-17) | Resin A (19) | 20 | (D-10) | 3/7 | 6 |
| Example 204 | (1-17) | Resin A (26) | 40 | (D-10) | 3/7 | 12 |
| Example 205 | (1-17) | Resin A (26) | 40 | (D-10) | 2/8 | 8 |
| Example 206 | (1-17) | Resin A (33) | 19 | (D-10) | 3/7 | 6 |
| Example 207 | (1-17) | Resin A (33) | 19 | (D-10) | 2/8 | 2 |

TABLE 9

| | Charge-transporting substance | Resin | Siloxane content A (% by mass) | Component [β] | Blending ratio of Resin F to Component [β] | Siloxane content B (% by mass) |
|---|---|---|---|---|---|---|
| Comp. Ex. 1 | (1-17) | Resin F(1) | 2 | (D-2) | 3/7 | 0.6 |
| Comp. Ex. 2 | (1-7)/(1-6) = 5/5 | Resin F(1) | 2 | (D-2)9 parts, (2-1)1 part | 3/7 | 0.6 |
| Comp. Ex. 3 | (1-15) | Resin F(1) | 2 | (D-2)9 parts, (2-2)1 part | 3/7 | 0.6 |
| Comp. Ex. 4 | (1-17) | Resin F(1) | 2 | (D-5) | 5/5 | 1 |
| Comp. Ex. 5 | (1-7)/(1-6) = 5/5 | Resin F(1) | 2 | (D-2)9 parts, (2-1)1 part | 5/5 | 1 |
| Comp. Ex. 6 | (1-15) | Resin F(1) | 2 | (D-2)9 parts, (2-2)1 part | 5/5 | 1 |
| Comp. Ex. 7 | (1-7)/(1-6) = 5/5 | Resin F(1) | 2 | — | — | 2 |
| Comp. Ex. 8 | (1-17) | Resin F(2) | 50 | (D-2) | 3/7 | 15 |
| Comp. Ex. 9 | (1-7)/(1-6) = 5/5 | Resin F(2) | 50 | (D-2)9 parts, (2-1)1 part | 3/7 | 15 |
| Comp. Ex. 10 | (1-15) | Resin F(2) | 50 | (D-2)9 parts, (2-2)1 part | 3/7 | 15 |
| Comp. Ex. 11 | (1-17) | Resin F(2) | 50 | (D-5) | 1/9 | 5 |
| Comp. Ex. 12 | (1-7)/(1-6) = 5/5 | Resin F(2) | 50 | (D-5)9 parts, (2-1)1 part | 1/9 | 5 |
| Comp. Ex. 13 | (1-15) | Resin F(2) | 50 | (D-5)9 parts, (2-2)1 part | 1/9 | 5 |
| Comp. Ex. 14 | (1-15) | Resin F(2) | 50 | — | — | 50 |
| Comp. Ex. 15 | (1-15) | Resin F(3) | 20 | (D-2) | 3/7 | 6 |
| Comp. Ex. 16 | (1-7)/(1-6) = 5/5 | Resin F(3) | 20 | (D-2)9 parts, (2-1)1 part | 3/7 | 6 |
| Comp. Ex. 17 | (1-17) | Resin F(3) | 20 | (D-2)9 parts, (2-2)1 part | 3/7 | 6 |
| Comp. Ex. 18 | (1-15) | Resin F(3) | 20 | (D-5) | 5/5 | 10 |
| Comp. Ex. 19 | (1-7)/(1-6) = 5/5 | Resin F(3) | 20 | (D-5)9 parts, (2-1)1 part | 5/5 | 10 |
| Comp. Ex. 20 | (1-17) | Resin F(3) | 20 | (D-5)9 parts, (2-2)1 part | 5/5 | 10 |
| Comp. Ex. 21 | (1-15) | Resin F(4) | 20 | (D-2) | 3/7 | 6 |
| Comp. Ex. 22 | (1-7)/(1-6) = 5/5 | Resin F(4) | 20 | (D-2)9 parts, (2-1)1 part | 3/7 | 6 |
| Comp. Ex. 23 | (1-17) | Resin F(4) | 20 | (D-2)9 parts, (2-2)1 part | 3/7 | 6 |
| Comp. Ex. 24 | (1-15) | Resin F(4) | 20 | (D-5) | 5/5 | 10 |
| Comp. Ex. 25 | (1-7)/(1-6) = 5/5 | Resin F(4) | 20 | (D-5)9 parts, (2-1)1 part | 5/5 | 10 |
| Comp. Ex. 26 | (1-17) | Resin F(4) | 20 | (D-5)9 parts, (2-2)1 part | 5/5 | 10 |
| Comp. Ex. 27 | (1-17) | Resin F(5) | 20 | (D-5) | 3/7 | 6 |
| Comp. Ex. 28 | (1-17) | Resin F(5) | 20 | (D-5) | 5/5 | 10 |
| Comp. Ex. 29 | (1-17) | Resin F(6) | 20 | (D-2) | 3/7 | 6 |
| Comp. Ex. 30 | (1-17) | Resin F(6) | 20 | (D-2) | 5/5 | 10 |
| Comp. Ex. 31 | (1-15) | Resin F(7) | 20 | (D-5) | 3/7 | 6 |
| Comp. Ex. 32 | (1-7)/(1-6) = 5/5 | Resin F(7) | 20 | (D-5)9 parts, (2-1)1 part | 3/7 | 6 |
| Comp. Ex. 33 | (1-17) | Resin F(7) | 20 | (D-5)9 parts, (2-2)1 part | 3/7 | 6 |
| Comp. Ex. 34 | (1-14) | Resin F(7) | 20 | (D-2) | 5/5 | 10 |
| Comp. Ex. 35 | (1-15) | Resin F(7) | 20 | (D-2)9 parts, (2-1)1 part | 5/5 | 10 |
| Comp. Ex. 36 | (1-17) | Resin F(7) | 20 | (D-2)9 parts, (2-2)1 part | 5/5 | 10 |
| Comp. Ex. 37 | (1-17) | Resin F(8) | 20 | (D-2) | 3/7 | 6 |
| Comp. Ex. 38 | (1-15) | Resin F(8) | 20 | (D-2) | 5/5 | 10 |
| Comp. Ex. 39 | (1-17) | Resin F(9) | 20 | (D-5) | 3/7 | 6 |

TABLE 9-continued

| | Charge-transporting substance | Resin | Siloxane content A (% by mass) | Component [β] | Blending ratio of Resin F to Component [β] | Siloxane content B (% by mass) |
|---|---|---|---|---|---|---|
| Comp. Ex. 40 | (1-15) | Resin F(9) | 20 | (D-5) | 5/5 | 10 |
| Comp. Ex. 41 | (1-14) | Resin G | 30 | (D-5) | 3/7 | 9 |
| Comp. Ex. 42 | (1-14) | Resin G | 30 | (D-5)9 parts, (2-2)1 part | 3/7 | 9 |
| Comp. Ex. 43 | (1-14) | Resin G | 30 | (D-10) | 3/7 | 9 |
| Comp. Ex. 44 | (1-14) | Resin G | 30 | (D-5) | 5/5 | 15 |
| Comp. Ex. 45 | (1-14) | Resin G | 30 | (D-5)9 parts, (2-2)1 part | 5/5 | 15 |
| Comp. Ex. 46 | (1-14) | Resin G | 30 | (D-10) | 5/5 | 15 |
| Comp. Ex. 47 | (1-15) | Resin F(10) | 20 | (D-2) | 3/7 | 6 |
| Comp. Ex. 48 | (1-15) | Resin F(10) | 20 | (D-2)9 parts, (2-2)1 part | 3/7 | 6 |
| Comp. Ex. 49 | (1-17) | Resin F(10) | 20 | (D-10) | 3/7 | 6 |
| Comp. Ex. 50 | (1-15) | Resin F(10) | 20 | (D-2) | 5/5 | 10 |
| Comp. Ex. 51 | (1-15) | Resin F(10) | 20 | (D-2)9 parts, (2-2)1 part | 5/5 | 10 |
| Comp. Ex. 52 | (1-17) | Resin F(10) | 20 | (D-10) | 5/5 | 10 |
| Comp. Ex. 53 | (1-11)/(1-14) = 9/1 | Resin A (15) | 20 | (3-1) | 5/5 | 10 |
| Comp. Ex. 54 | (1-11)/(1-14) = 9/1 | Resin A (15) | 20 | (3-2) | 5/5 | 10 |
| Comp. Ex. 55 | (1-11)/(1-14) = 9/1 | Resin A (15) | 20 | (3-3) | 5/5 | 10 |
| Comp. Ex. 56 | (1-11)/(1-14) = 9/1 | Resin A (15) | 20 | (3-3) | 3/7 | 6 |
| Comp. Ex. 57 | (1-11)/(1-14) = 9/1 | Resin A(15) | 20 | (3-3) | 2/8 | 2 |
| Comp. Ex. 58 | (1-17) | Resin F(1) | 2 | (D-10) | 3/7 | 0.6 |
| Comp. Ex. 59 | (1-15) | Resin F(2) | 50 | (D-10) | 3/7 | 15 |
| Comp. Ex. 60 | (1-15) | Resin F(3) | 20 | (D-10) | 3/7 | 6 |
| Comp. Ex. 61 | (1-15) | Resin F(4) | 20 | (D-10) | 5/5 | 10 |

In Table 9, each entry in the column "charge-transporting substance" refers to the charge-transporting substance contained in the charge-transporting layer. When the charge-transporting substances are blended, the entry refers to the types of charge-transporting substances and the blending ratio thereof. In Table 9, "Resin F" represents a resin F having a siloxane moiety. In Table 9, each entry in the column "Siloxane content A (% by mass)" refers to the content of a siloxane moiety (% by mass) in "resin F". In Table 9, each entry in the column "Component [β]" refers to the composition of the constituent β. In Table 9, each entry in the column "Blending ratio of Resin F and Component [β]" refers to a blending ratio of resin F or polycarbonate resin A and the constituent β in a charge-transporting layer (resin F/the constituent β). In Table 9, each entry in the column "Siloxane content B (% by mass)" refers to the content of the siloxane moiety (% by mass) in "resin F" relative to the total mass of all resins in the charge-transporting layer. In Table 9, the numbers (parts) of the formula (D) and the formula (2) in the column "Component [β]" each represent a blending amount of resins.

TABLE 10

| | Potential variation (V) | Initial torque relative value | Torque relative value after 3,000 sheets | Particle diameter (nm) |
|---|---|---|---|---|
| Example 1 | 16 | 0.59 | 0.60 | 460 |
| Example 2 | 16 | 0.54 | 0.63 | 470 |
| Example 3 | 17 | 0.58 | 0.63 | 430 |
| Example 4 | 20 | 0.58 | 0.62 | 440 |
| Example 5 | 17 | 0.60 | 0.61 | 420 |
| Example 6 | 18 | 0.58 | 0.60 | 430 |
| Example 7 | 16 | 0.60 | 0.64 | 440 |
| Example 8 | 17 | 0.61 | 0.67 | 420 |
| Example 9 | 21 | 0.59 | 0.65 | 400 |
| Example 10 | 20 | 0.59 | 0.66 | 420 |
| Example 11 | 21 | 0.61 | 0.64 | 420 |
| Example 12 | 22 | 0.63 | 0.66 | 400 |
| Example 13 | 14 | 0.65 | 0.69 | 330 |
| Example 14 | 13 | 0.59 | 0.65 | 320 |
| Example 15 | 11 | 0.61 | 0.64 | 290 |
| Example 16 | 16 | 0.60 | 0.65 | 280 |
| Example 17 | 15 | 0.60 | 0.64 | 290 |

TABLE 10-continued

| | Potential variation (V) | Initial torque relative value | Torque relative value after 3,000 sheets | Particle diameter (nm) |
|---|---|---|---|---|
| Example 18 | 14 | 0.62 | 0.66 | 320 |
| Example 19 | 15 | 0.63 | 0.68 | 310 |
| Example 20 | 13 | 0.61 | 0.68 | 320 |
| Example 21 | 16 | 0.65 | 0.75 | 400 |
| Example 22 | 19 | 0.66 | 0.81 | 420 |
| Example 23 | 21 | 0.64 | 0.78 | 440 |
| Example 24 | 20 | 0.77 | 0.75 | 450 |
| Example 25 | 20 | 0.76 | 0.81 | 320 |
| Example 26 | 19 | 0.77 | 0.81 | 370 |
| Example 27 | 20 | 0.77 | 0.80 | 380 |
| Example 28 | 21 | 0.77 | 0.79 | 330 |
| Example 29 | 20 | 0.75 | 0.81 | 320 |
| Example 30 | 18 | 0.61 | 0.67 | 440 |
| Example 31 | 20 | 0.62 | 0.67 | 450 |
| Example 32 | 21 | 0.64 | 0.70 | 450 |
| Example 33 | 21 | 0.69 | 0.68 | 370 |
| Example 34 | 22 | 0.72 | 0.74 | 320 |
| Example 35 | 22 | 0.70 | 0.75 | 330 |
| Example 36 | 21 | 0.66 | 0.72 | 440 |
| Example 37 | 20 | 0.63 | 0.68 | 430 |
| Example 38 | 19 | 0.65 | 0.69 | 410 |
| Example 39 | 19 | 0.63 | 0.68 | 370 |
| Example 40 | 21 | 0.61 | 0.70 | 370 |
| Example 41 | 21 | 0.66 | 0.75 | 360 |
| Example 42 | 20 | 0.67 | 0.70 | 350 |
| Example 43 | 21 | 0.64 | 0.70 | 320 |
| Example 44 | 22 | 0.62 | 0.64 | 330 |
| Example 45 | 21 | 0.77 | 0.81 | 320 |
| Example 46 | 20 | 0.77 | 0.80 | 310 |
| Example 47 | 19 | 0.79 | 0.81 | 330 |
| Example 48 | 24 | 0.67 | 0.69 | 440 |
| Example 49 | 25 | 0.67 | 0.69 | 430 |
| Example 50 | 24 | 0.65 | 0.70 | 440 |
| Example 51 | 19 | 0.63 | 0.66 | 440 |
| Example 52 | 22 | 0.65 | 0.69 | 430 |
| Example 53 | 18 | 0.64 | 0.72 | 350 |
| Example 54 | 21 | 0.71 | 0.75 | 380 |
| Example 55 | 23 | 0.77 | 0.81 | 330 |
| Example 56 | 20 | 0.72 | 0.75 | 330 |
| Example 57 | 21 | 0.77 | 0.77 | 350 |
| Example 58 | 20 | 0.78 | 0.83 | 440 |
| Example 59 | 22 | 0.77 | 0.77 | 450 |
| Example 60 | 25 | 0.73 | 0.76 | 490 |

TABLE 10-continued

| | Potential variation (V) | Initial torque relative value | Torque relative value after 3,000 sheets | Particle diameter (nm) |
|---|---|---|---|---|
| Example 61 | 24 | 0.66 | 0.70 | 380 |
| Example 62 | 24 | 0.66 | 0.65 | 370 |
| Example 63 | 21 | 0.71 | 0.69 | 420 |
| Example 64 | 23 | 0.69 | 0.72 | 420 |
| Example 65 | 22 | 0.66 | 0.69 | 410 |
| Example 66 | 23 | 0.61 | 0.67 | 420 |
| Example 67 | 22 | 0.63 | 0.68 | 400 |
| Example 68 | 22 | 0.63 | 0.70 | 390 |
| Example 69 | 27 | 0.67 | 0.68 | 360 |
| Example 70 | 28 | 0.63 | 0.65 | 350 |
| Example 71 | 24 | 0.64 | 0.69 | 410 |
| Example 72 | 25 | 0.71 | 0.70 | 420 |
| Example 73 | 22 | 0.78 | 0.82 | 420 |
| Example 74 | 19 | 0.64 | 0.66 | 420 |
| Example 75 | 18 | 0.72 | 0.69 | 400 |
| Example 76 | 17 | 0.69 | 0.70 | 370 |
| Example 77 | 21 | 0.71 | 0.69 | 390 |
| Example 78 | 26 | 0.66 | 0.69 | 400 |
| Example 79 | 23 | 0.64 | 0.71 | 380 |
| Example 80 | 24 | 0.54 | 0.67 | 390 |
| Example 81 | 19 | 0.61 | 0.66 | 360 |
| Example 82 | 21 | 0.63 | 0.67 | 370 |
| Example 83 | 20 | 0.68 | 0.70 | 350 |
| Example 84 | 19 | 0.70 | 0.71 | 410 |
| Example 85 | 23 | 0.63 | 0.66 | 450 |
| Example 86 | 23 | 0.65 | 0.67 | 420 |
| Example 87 | 24 | 0.64 | 0.68 | 430 |
| Example 88 | 20 | 0.65 | 0.68 | 400 |
| Example 89 | 12 | 0.41 | 0.59 | 280 |
| Example 90 | 12 | 0.42 | 0.56 | 260 |
| Example 91 | 11 | 0.45 | 0.55 | 270 |
| Example 92 | 9 | 0.33 | 0.53 | 220 |
| Example 93 | 9 | 0.35 | 0.50 | 200 |
| Example 94 | 8 | 0.35 | 0.52 | 230 |
| Example 95 | 8 | 0.37 | 0.51 | 240 |
| Example 96 | 8 | 0.37 | 0.54 | 230 |
| Example 97 | 7 | 0.37 | 0.53 | 240 |
| Example 98 | 7 | 0.41 | 0.55 | 250 |
| Example 99 | 10 | 0.41 | 0.54 | 260 |
| Example 100 | 9 | 0.38 | 0.53 | 230 |

In Tables 10 to 12, "particle diameter" represents the number average particle size of domains.

TABLE 11

| | Potential variation (V) | Initial torque relative value | Torque relative value after 3,000 sheets | Particle diameter (nm) |
|---|---|---|---|---|
| Example 101 | 8 | 0.41 | 0.53 | 250 |
| Example 102 | 13 | 0.42 | 0.56 | 240 |
| Example 103 | 11 | 0.39 | 0.59 | 240 |
| Example 104 | 11 | 0.42 | 0.59 | 250 |
| Example 105 | 9 | 0.44 | 0.57 | 280 |
| Example 106 | 8 | 0.48 | 0.61 | 230 |
| Example 107 | 7 | 0.46 | 0.60 | 240 |
| Example 108 | 9 | 0.45 | 0.61 | 230 |
| Example 109 | 29 | 0.58 | 0.71 | 410 |
| Example 110 | 25 | 0.55 | 0.65 | 390 |
| Example 111 | 26 | 0.59 | 0.69 | 360 |
| Example 112 | 27 | 0.60 | 0.72 | 350 |
| Example 113 | 27 | 0.55 | 0.72 | 350 |
| Example 114 | 28 | 0.54 | 0.66 | 360 |
| Example 115 | 23 | 0.75 | 0.75 | 410 |
| Example 116 | 24 | 0.68 | 0.72 | 380 |
| Example 117 | 24 | 0.70 | 0.72 | 410 |
| Example 118 | 28 | 0.78 | 0.75 | 380 |
| Example 119 | 23 | 0.79 | 0.76 | 380 |
| Example 120 | 24 | 0.77 | 0.79 | 380 |
| Example 121 | 25 | 0.78 | 0.79 | 400 |
| Example 122 | 22 | 0.75 | 0.76 | 410 |

TABLE 11-continued

| | Potential variation (V) | Initial torque relative value | Torque relative value after 3,000 sheets | Particle diameter (nm) |
|---|---|---|---|---|
| Example 123 | 25 | 0.76 | 0.77 | 400 |
| Example 124 | 24 | 0.77 | 0.79 | 400 |
| Example 125 | 25 | 0.75 | 0.80 | 420 |
| Example 126 | 14 | 0.59 | 0.62 | 280 |
| Example 127 | 15 | 0.61 | 0.61 | 290 |
| Example 128 | 12 | 0.58 | 0.68 | 300 |
| Example 129 | 24 | 0.74 | 0.76 | 420 |
| Example 130 | 22 | 0.73 | 0.79 | 410 |
| Example 131 | 22 | 0.75 | 0.77 | 400 |
| Example 132 | 25 | 0.74 | 0.78 | 410 |
| Example 133 | 25 | 0.75 | 0.80 | 400 |
| Example 134 | 21 | 0.75 | 0.77 | 420 |
| Example 135 | 21 | 0.76 | 0.76 | 390 |
| Example 136 | 23 | 0.76 | 0.76 | 410 |
| Example 137 | 23 | 0.75 | 0.77 | 410 |
| Example 138 | 25 | 0.75 | 0.79 | 380 |
| Example 139 | 24 | 0.76 | 0.78 | 360 |
| Example 140 | 24 | 0.75 | 0.77 | 390 |
| Example 141 | 26 | 0.74 | 0.76 | 390 |
| Example 142 | 22 | 0.75 | 0.76 | 410 |
| Example 143 | 24 | 0.75 | 0.77 | 410 |
| Example 144 | 21 | 0.76 | 0.78 | 370 |
| Example 145 | 24 | 0.73 | 0.75 | 380 |
| Example 146 | 25 | 0.70 | 0.73 | 380 |
| Example 147 | 24 | 0.74 | 0.75 | 380 |
| Example 148 | 21 | 0.71 | 0.74 | 410 |
| Example 149 | 14 | 0.57 | 0.61 | 280 |
| Example 150 | 15 | 0.56 | 0.63 | 270 |
| Example 151 | 24 | 0.68 | 0.71 | 340 |
| Example 152 | 26 | 0.70 | 0.72 | 390 |
| Example 153 | 23 | 0.76 | 0.77 | 340 |
| Example 154 | 24 | 0.71 | 0.73 | 350 |
| Example 155 | 24 | 0.68 | 0.72 | 350 |
| Example 156 | 23 | 0.66 | 0.73 | 390 |
| Example 157 | 25 | 0.68 | 0.71 | 380 |
| Example 158 | 22 | 0.68 | 0.75 | 400 |
| Example 159 | 13 | 0.54 | 0.60 | 270 |
| Example 160 | 14 | 0.56 | 0.61 | 280 |
| Example 161 | 24 | 0.66 | 0.73 | 400 |
| Example 162 | 21 | 0.71 | 0.74 | 420 |
| Example 163 | 22 | 0.67 | 0.71 | 420 |
| Example 164 | 27 | 0.65 | 0.73 | 410 |
| Example 165 | 22 | 0.70 | 0.74 | 390 |
| Example 166 | 23 | 0.70 | 0.76 | 400 |
| Example 167 | 26 | 0.72 | 0.77 | 390 |
| Example 168 | 24 | 0.72 | 0.76 | 400 |
| Example 169 | 15 | 0.55 | 0.64 | 280 |
| Example 170 | 13 | 0.54 | 0.60 | 270 |
| Example 171 | 28 | 0.60 | 0.68 | 310 |
| Example 172 | 29 | 0.66 | 0.68 | 330 |
| Example 173 | 30 | 0.61 | 0.70 | 340 |
| Example 174 | 28 | 0.60 | 0.65 | 300 |
| Example 175 | 26 | 0.60 | 0.66 | 290 |
| Example 176 | 19 | 0.58 | 0.59 | 300 |
| Example 177 | 20 | 0.54 | 0.62 | 320 |
| Example 178 | 22 | 0.51 | 0.66 | 330 |
| Example 179 | 23 | 0.66 | 0.67 | 310 |
| Example 180 | 20 | 0.61 | 0.68 | 270 |
| Example 181 | 18 | 0.62 | 0.66 | 330 |
| Example 182 | 7 | 0.37 | 0.55 | 220 |
| Example 183 | 8 | 0.38 | 0.54 | 210 |
| Example 184 | 12 | 0.51 | 0.57 | 280 |
| Example 185 | 13 | 0.50 | 0.55 | 280 |
| Example 186 | 11 | 0.54 | 0.59 | 280 |
| Example 187 | 12 | 0.51 | 0.60 | 280 |
| Example 188 | 22 | 0.67 | 0.71 | 320 |
| Example 189 | 21 | 0.66 | 0.68 | 340 |
| Example 190 | 24 | 0.61 | 0.68 | 350 |
| Example 191 | 20 | 0.64 | 0.69 | 360 |
| Example 192 | 24 | 0.65 | 0.67 | 380 |
| Example 193 | 23 | 0.62 | 0.69 | 330 |
| Example 194 | 21 | 0.61 | 0.70 | 340 |
| Example 195 | 24 | 0.64 | 0.69 | 300 |
| Example 196 | 12 | 050 | 0.59 | 270 |
| Example 197 | 14 | 0.51 | 0.58 | 250 |

TABLE 11-continued

| | Potential variation (V) | Initial torque relative value | Torque relative value after 3,000 sheets | Particle diameter (nm) |
|---|---|---|---|---|
| Example 198 | 23 | 0.60 | 0.70 | 320 |
| Example 199 | 24 | 0.66 | 0.68 | 340 |
| Example 200 | 25 | 0.61 | 0.69 | 350 |
| Example 201 | 26 | 0.64 | 0.68 | 360 |
| Example 202 | 25 | 0.65 | 0.66 | 380 |
| Example 203 | 23 | 0.62 | 0.70 | 330 |
| Example 204 | 25 | 0.60 | 0.70 | 340 |
| Example 205 | 24 | 0.64 | 0.69 | 300 |
| Example 206 | 13 | 0.49 | 0.58 | 260 |
| Example 207 | 13 | 0.51 | 0.58 | 240 |

TABLE 12

| | Potential variation (V) | Initial torque relative value | Torque relative value after 3,000 sheets | Particle diameter (nm) |
|---|---|---|---|---|
| Comp. Ex. 1 | 19 | 0.96 | 0.97 | — |
| Comp. Ex. 2 | 20 | 0.98 | 0.98 | — |
| Comp. Ex. 3 | 20 | 0.95 | 0.98 | — |
| Comp. Ex. 4 | 17 | 0.92 | 0.98 | — |
| Comp. Ex. 5 | 19 | 0.95 | 0.99 | — |
| Comp. Ex. 6 | 21 | 0.98 | 0.94 | — |
| Comp. Ex. 7 | 20 | 0.96 | 0.97 | — |
| Comp. Ex. 8 | 92 | 0.57 | 0.8 | 1000 |
| Comp. Ex. 9 | 90 | 0.62 | 0.83 | 1060 |
| Comp. Ex. 10 | 87 | 0.64 | 0.85 | 1020 |
| Comp. Ex. 11 | 82 | 0.64 | 0.84 | 1050 |
| Comp. Ex. 12 | 99 | 0.63 | 0.84 | 1080 |
| Comp. Ex. 13 | 102 | 0.66 | 0.83 | 950 |
| Comp. Ex. 14 | 56 | 0.94 | 0.96 | — |
| Comp. Ex. 15 | 42 | 0.91 | 0.97 | — |
| Comp. Ex. 16 | 56 | 0.88 | 0.94 | — |
| Comp. Ex. 17 | 51 | 0.91 | 0.95 | — |
| Comp. Ex. 18 | 47 | 0.9 | 0.94 | — |
| Comp. Ex. 19 | 53 | 0.88 | 0.96 | — |
| Comp. Ex. 20 | 51 | 0.9 | 0.97 | — |
| Comp. Ex. 21 | 138 | 0.68 | 0.79 | 1300 |
| Comp. Ex. 22 | 130 | 0.65 | 0.82 | 1200 |
| Comp. Ex. 23 | 144 | 0.68 | 0.83 | 1250 |
| Comp. Ex. 24 | 135 | 0.7 | 0.82 | 1350 |
| Comp. Ex. 25 | 149 | 0.71 | 0.82 | 1100 |
| Comp. Ex. 26 | 141 | 0.74 | 0.85 | 1150 |
| Comp. Ex. 27 | 71 | 0.82 | 0.95 | — |
| Comp. Ex. 28 | 78 | 0.85 | 0.99 | — |
| Comp. Ex. 29 | 88 | 0.87 | 0.97 | — |
| Comp. Ex. 30 | 118 | 0.9 | 0.95 | — |
| Comp. Ex. 31 | 113 | 0.85 | 0.96 | — |
| Comp. Ex. 32 | 98 | 0.86 | 0.97 | — |
| Comp. Ex. 33 | 101 | 0.88 | 0.96 | — |
| Comp. Ex. 34 | 96 | 0.9 | 0.97 | — |
| Comp. Ex. 35 | 104 | 0.9 | 0.98 | — |
| Comp. Ex. 36 | 91 | 0.91 | 0.97 | — |
| Comp. Ex. 37 | 21 | 0.78 | 0.83 | — |
| Comp. Ex. 38 | 24 | 0.74 | 0.84 | — |
| Comp. Ex. 39 | 81 | 0.61 | 0.75 | 720 |
| Comp. Ex. 40 | 91 | 0.6 | 0.76 | 870 |
| Comp. Ex. 41 | 48 | 0.62 | 0.78 | 500 |
| Comp. Ex. 42 | 50 | 0.67 | 0.77 | 490 |
| Comp. Ex. 43 | 55 | 0.68 | 0.73 | 480 |
| Comp. Ex. 44 | 48 | 0.71 | 0.75 | 510 |
| Comp. Ex. 45 | 52 | 0.71 | 0.74 | 500 |
| Comp. Ex. 46 | 54 | 0.69 | 0.73 | 520 |
| Comp. Ex. 47 | 77 | 0.9 | 0.97 | — |
| Comp. Ex. 48 | 76 | 0.89 | 0.99 | — |
| Comp. Ex. 49 | 78 | 0.92 | 0.95 | — |
| Comp. Ex. 50 | 78 | 0.94 | 0.97 | — |
| Comp. Ex. 51 | 76 | 0.91 | 0.98 | — |
| Comp. Ex. 52 | 75 | 0.94 | 0.98 | — |
| Comp. Ex. 53 | 68 | 0.88 | 0.92 | — |
| Comp. Ex. 54 | 69 | 0.86 | 0.96 | — |

TABLE 12-continued

| | Potential variation (V) | Initial torque relative value | Torque relative value after 3,000 sheets | Particle diameter (nm) |
|---|---|---|---|---|
| Comp. Ex. 55 | 74 | 0.89 | 0.97 | — |
| Comp. Ex. 56 | 69 | 0.82 | 0.96 | — |
| Comp. Ex. 57 | 71 | 0.85 | 0.98 | — |
| Comp. Ex. 58 | 22 | 0.95 | 0.98 | — |
| Comp. Ex. 59 | 93 | 0.63 | 0.84 | 1100 |
| Comp. Ex. 60 | 51 | 0.88 | 0.95 | — |
| Comp. Ex. 61 | 125 | 0.71 | 0.82 | 1180 |

In comparison between Examples and Comparative Examples 1 to 6 and Example 58 if the content of a siloxane moiety in a polycarbonate resin containing the siloxane moiety of the charge-transporting layer is low, a sufficient contact stress-reducing effect is not obtained. This is supported by the evaluation between initial torque and after 3000-sheet use showing that no torque-reducing effect is obtained. Furthermore, Comparative Example 7 demonstrates that if the content of a siloxane moiety in a polycarbonate resin containing the siloxane moiety of the charge-transporting layer is low, even if the content of a siloxane-containing resin in the charge-transporting layer is increased, a sufficient contact stress-reducing effect cannot be obtained.

In comparison between Examples and Comparative Examples 8 to 13 and Example 59, if the content of a siloxane moiety in a polycarbonate resin containing the siloxane moiety of the charge-transporting layer is high, potential stability during repeated use is insufficient. In this case, a matrix-domain structure is formed of a polycarbonate resin containing a siloxane moiety; however, since an excessive amount of siloxane structure is contained in the polycarbonate resin of the charge-transporting layer, compatibility with a charge-transporting substance becomes insufficient. For the reason, the effect of potential stability during repeated use cannot be obtained. Furthermore, also in the results of Comparative Example 14, potential stability during repeated use is insufficient. From the results of Comparative Example 14, it is found that even if a matrix-domain structure is not formed, a large potential variation occurs. In other words, in Comparative Examples 8 to 14, if a resin having a charge-transporting substance and an excessive amount of siloxane structure is contained, compatibility with a charge-transporting substance is conceivably insufficient.

In comparison with Examples, Comparative Examples 15 to 20, Comparative Examples 27 to 36 and Comparative Example 60, if the content of the repeating structural unit represented by the formula (B) in the polycarbonate resin A serving as the constituent $\alpha$ is low, a matrix-domain structure is not formed and a sufficient contact stress-reducing effect is not obtained. This is supported by the evaluation between initial torque and after 3000-sheet use showing that a torque-reducing effect is not sufficient.

In comparison with Examples and Comparative Examples 21 to 26 and Comparative Example 61, if the content of the repeating structural unit represented by the formula (B) in the polycarbonate resin A serving as the constituent $\alpha$ is high, a matrix-domain structure is formed but and the effect of potential stability during repeated use is insufficient.

In comparison with Examples and Comparative Examples 37 to 40, if the repeating structural unit represented by the formula (A) in the polycarbonate resin A is outside the range of the present invention, a persistent contact stress-reducing effect and potential stability during repeated use are not sufficiently ensured.

In comparison with Examples and Comparative Examples 41 to 46, it is demonstrated that a further higher persistent contact stress-reducing effect can be obtained in the constitution of the present invention compared to the case where a matrix-domain structure is formed by use of a polyester resin having a siloxane structure. This demonstrates that potential stability during repeated use and persistent contact-stress reduction can be further more efficiently ensured by use of the polycarbonate resin A of the present invention. This is conceivably because domains are further uniformly miniaturized by containing the repeating structural unit represented by the formula (B) of the present invention in a specific content, with the result that a domain is clearly separated from a matrix in the charge-transporting layer. Furthermore, in comparison with Examples and Comparative Examples 47 to 52, if the repeating structural unit represented by formula (C) is not used in the constituent α, a persistent contact stress-reducing effect is not sufficiently obtained. This is demonstrated by the evaluation between initial torque and after 3,000-sheet use showing that a torque-reducing effect is not sufficient. Similarly, in comparison with Examples and Comparative Examples 53 to 57, if the constituent β is not the repeating structural unit represented by the formula (D), a persistent contact stress-reducing effect is not sufficiently obtained. This is supported by the evaluation between initial torque and after 3,000-sheet use showing that a torque-reducing effect is not sufficient.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-088440, filed Apr. 12, 2011, and Japanese Patent Application No. 2012-063761, filed Mar. 21, 2012, which are hereby incorporated by reference herein in their entirety.

The invention claimed is:

1. An electrophotographic photosensitive member, comprising:

a support, a charge-generating layer which is provided on the support and comprises a charge-generating substance, and a charge-transporting layer which is provided on the charge-generating layer and is a surface layer of the electrophotographic photosensitive member;

wherein the charge-transporting layer has a matrix-domain structure having:

a domain which comprises the constituent α, and a matrix which comprises the constituent β and a charge-transporting substance;

wherein the constituent γ is a polycarbonate resin A having a repeating structural unit represented by the following formula (A), a repeating structural unit represented by the following formula (B) and a repeating structural unit represented by the following formula (C), the content of a siloxane moiety in the polycarbonate resin A is not less than 5% by mass and not more than 40% by mass relative to the total mass of the polycarbonate resin A, the content of the repeating structural unit represented by the formula (B) is not less than 10% by mass and not more than 30% by mass relative to the total mass of the polycarbonate resin A, and the content of the repeating structural unit represented by the formula (C) is not less than 25% by mass and less than 85% by mass relative to the total mass of the polycarbonate resin A;

(A)

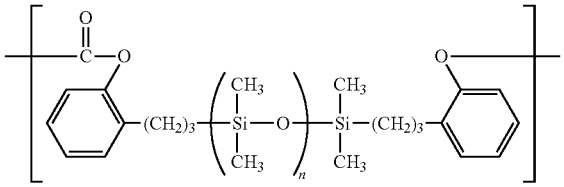

wherein, in the formula (A),

"n" represents number of repetitions of a structure within the bracket, an average of "n" in the polycarbonate resin A ranges from 20 to 60;

(B)

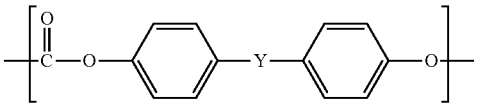

wherein, in the formula (B), Y represents an oxygen atom or a sulfur atom;

(C)

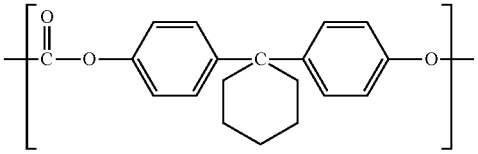

wherein the constituent β is a polyester resin D having a repeating structural unit represented by the following formula (D);

(D)

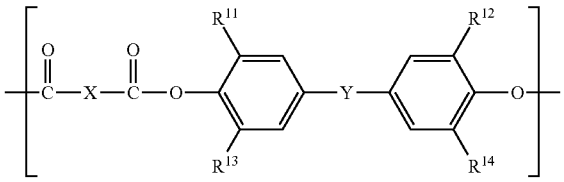

wherein, in the formula (D), $R^{11}$ to $R^{14}$ each independently represents a hydrogen atom, or a methyl group, X represents a meta-phenylene group, a para-phenylene group, or a bivalent group having two para-phenylene groups bonded with an oxygen atom, and Y represents a single bond, a methylene group, an ethylidene group, or a propylidene group.

2. An electrophotographic photosensitive member according to claim 1, wherein the content of the siloxane moiety in the charge-transporting layer is not less than 1% by mass and not more than 20% by mass relative to the total mass of all resins in the charge-transporting layer.

3. A process cartridge detachably attachable to a main body of an electrophotographic apparatus, wherein the process cartridge integrally supports:

the electrophotographic photosensitive member according to claim 1; and at least one device selected from the group consisting of a charging device, a developing device, a transferring device, and a cleaning device.

4. An electrophotographic apparatus, comprising: the electrophotographic photosensitive member according to claim 1; a charging device; an exposing device; a developing device; and a transferring device.

5. A method of manufacturing the electrophotographic photosensitive member according to claim 1, wherein the method comprises a step of forming the charge-transporting layer by applying a charge-transporting-layer coating solution on the charge-generating layer, and wherein the charge-transporting-layer coating solution comprises the constituent α, the constituent β, and the charge-transporting substance.

* * * * *